US005493319A

United States Patent [19]

Hirabayashi et al.

[11] Patent Number: 5,493,319

[45] Date of Patent: Feb. 20, 1996

[54] METHOD OF RESTORING INK EJECTION BY HEATING AN JET HEAD BEFORE CLEANING

[75] Inventors: Hiromitsu Hirabayashi, Yokohama; Naoji Ohtsuka, Kawasaki; Kentaro Yano; Hitoshi Sugimoto, both of Yokohama; Miyuki Matsubara, Tokyo; Kiichiro Takahashi, Yokohama, all of Japan

[73] Assignee: Canon Kabushiki Kaisha, Tokyo, Japan

[21] Appl. No.: 223,321

[22] Filed: Apr. 5, 1994

Related U.S. Application Data

[63] Continuation of Ser. No. 833,910, Feb. 11, 1992, abandoned.

[30] Foreign Application Priority Data

Feb. 12, 1991 [JP] Japan ..... 3-018966
Feb. 12, 1991 [JP] Japan ..... 3-018967

[51] Int. Cl.[6] ..... B41J 2/165

[52] U.S. Cl. ..... 347/29; 347/30; 347/33; 347/35

[58] Field of Search ..... 346/1.1, 140 R; 400/126; 347/22, 26, 29, 35, 33, 60, 30

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,394,669 | 7/1983 | Ozawa et al. | 347/30 X |
| 4,459,600 | 7/1984 | Sato et al. | 347/47 |
| 4,463,359 | 7/1984 | Ayata et al. | 347/56 |
| 4,504,845 | 3/1985 | Kattner et al. | 347/44 X |
| 4,558,333 | 12/1985 | Sugitani et al. | 347/65 |
| 4,712,172 | 12/1987 | Kiyohara et al. | 347/60 |
| 4,723,129 | 2/1988 | Endo et al. | 347/56 |
| 4,740,796 | 4/1988 | Endo et al. | 347/56 |
| 4,791,435 | 12/1988 | Smith et al. | 347/35 X |
| 4,893,138 | 1/1990 | Terasawa et al. | 347/30 |
| 4,926,196 | 5/1990 | Mizoguchi et al. | 347/30 X |
| 4,970,535 | 11/1990 | Oswald et al. | 347/25 |
| 5,202,702 | 4/1993 | Terasawa et al. | 347/33 X |

FOREIGN PATENT DOCUMENTS

| | | |
|---|---|---|
| 0273362 | 7/1988 | European Pat. Off. . |
| 0375407 | 6/1990 | European Pat. Off. . |
| 0398348 | 11/1990 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 61-249758 | 11/1986 | Japan . |
| 62-113561 | 5/1987 | Japan . |
| 03073352 | 3/1991 | Japan . |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

An ink jet recording apparatus for recording information by ejecting ink fluid on a recording medium includes a recording head, a cap, an ejection restoration mechanism, an atmospheric air opening mechanism and a heating mechanism. The recording head has an orifice and ejects ink fluid from the orifice. The cap covers up a face on which the orifice of the recording head is disposed. The ejection restoration mechanism performs procedures for keeping a state of ejection of ink fluid by the recording head to be good by discharging ink fluid into the cap. The atmospheric air opening mechanism makes an inside of the cap opened to an atmospheric air when the restoration operations are being performed by the ejection restoration mechanism. The heating mechanism heats the recording head at least before the restoration operation is performed by the ejection restoration mechanism.

6 Claims, 21 Drawing Sheets

METHOD OF RESTORING INK EJECTION BY HEATING AN JET HEAD BEFORE CLEANING

This application is a continuation of application Ser. No. 07/833,910 filed Feb. 11, 1992, now abandoned.

BACKGROUND OF THE INVENTION

1. Field of the Invention

The present invention relates to an ink jet recording apparatus, and particularly to a procedural structure for keeping an ink ejection performance in a good condition.

2. Description of the Related Art

In recent years, personal computers and office automation machines like word processors have been widely used, and a recording apparatus has also widely used as one way to output the processing results obtained by these apparatuses. A wire dotting method, a thermal printing method and an ink jet recording method are will known as a recording method used in the recording apparatus.

The ink jet recording method has several advantages that various kinds of recorded medium such as an unprocessed natural paper and a transparent sheet for OHP can be used and that the noise level generated during the recording operation is relatively small. One of ink fluid ejection methods used in the recording head of the ink jet recording method is to eject ink fluid by the pressure wave accompanied by the growth and diminish of a bubble in the ink fluid which is generated by the thermal energy. Recording heads using this ejection method are often formed within the following architecture. (1) Forming a plurality of heat-generation elements for generating thermal energy and driving circuits for driving heat-generation elements to generate thermal energy on a substrate made of silicon materials and so on in a similar fabricating processing to the semiconductor element processing. (2) By bonding the above defined substrate and a top plate having channels, forming a plurality of ink passages, each corresponding to each orifice and used for a chamber where thermal energy is transmitted to the ink fluid, a plurality of orifices, each defined at the open end part of each ink passage and used for ejecting ink fluid, and a common fluid reservoir defined at the opposite side to the orifice defined side of each ink passage and used for reserving ink fluid to supply ink fluid to each of the ink passages.

In addition to advantages obtained by the ink jet recording method, it will be appreciated that images recorded on the recording medium by using this type of recording head can be made to be clearer and finer because the structure of the orifice can be formed to be highly fine and precise. Additionally, the size of the recording head itself can be taken to be small and the fabricating and material cost can be reduced. So far, in recent years, the recording head ejecting ink fluid by using thermal energy as described above has been widely used in various kinds of recording apparatuses.

In case of such a recording head as the above described recording head having a relatively fine orifice and ink passage, an effect of the viscosity of the ink fluid on the ejection performance of the recording head is relatively high. For example, if the ink fluid in the ink passage near the orifice gets to be more viscous due to the evaporation of the solvent component of the ink fluid, there may be a case that the more viscous ink fluids disturb the ink fluid flow when ejecting ink fluid which leads to ink ejection failure such as the deflection of ejected ink fluid and the reduction of the amount of the ejected ink fluid and even results in the loss of ejecting ink fluid. And furthermore, in case that unnecessary ink droplets and unfavorable substances like paper powder adhere onto the orifice-disposed face of the recording head, the deflection of ejected ink fluid may occur and therefore the quality of recorded images may be reduced. As in the ink jet recording method, the ink fluid is ejected from the recording head onto the recording medium such as a paper sheet and a transparent sheet, for example, the ink mist composed of fine sized ink droplets may occur and the excess amount of the ink fluid ejected may rebound from the recording medium. As shown in FIG. 1, the ink mist and the rebounding ink fluid attach to the orifice-disposed face 1 of the recording head, and if the attaching ink fluid centers too much around the orifices 12, the ejection operation may be disturbed and the discharge direction may be deviated, and even the discharge operation may be stopped. In addition condensed water drops may be adhere onto the orifice-disposed face 1 due to the temperature difference between the recording head and the atmospheric air, which leads to the same adverse effects as found in case that the ink fluid attaches to the recording head.

With respect to the above described ink ejection failures due to increases in the viscosity of the ink fluid and the ink fluid drops adhere onto the orifice-disposed face, various kinds of operations for preventing these failures and for removing the causes to these failures in order to establish good-conditioned ink ejection operations are known as ejection restoration operations.

As one of these ejection restoration operations which is directed to resolve the ejection failure mainly due to increases in the viscosity of the ink fluids, for example, recognized is a capping operation in which a designated cap covers up the face on which the orifice of the recording head is formed (the orifice disposed face) in order to prevent water in the ink fluid from being evaporated from the orifice. A suction restoration operation is recognized, in which the viscous ink fluids are removed outside the recording head by sucking the ink fluid from the orifice by applying suction pressure inside the cap covering up the recording head. In addition, a pressurizing restoration operation is recognized as a substitution for the suction restoration operation or a combination with the suction restoration operation, in which the ink fluid is pressurized from the ink supply side of the ink passage and discharged from the orifice. In addition, as another ejection restoration operation, an ejection operation is recognized, in which the viscous ink fluid in the recording head is discharged by ejecting ink fluids not used for recording information or images on the recording media, and which is designated as an idle ejection operation. The above described ejection restoration operations are not only for removing the viscous ink fluids but also for removing bubbles in the ink fluid giving adverse effects on the ink fluid ejection performance.

As one of the ejection restoration operations which is directed to resolve the ejection failure mainly due to unfavorable substances adhering onto the recording head, a structure is known in which the orifice-disposed face is maintained to be cleaned in order to prevent the ejection direction deviation. In a typical structure, a wiping member is disposed so that the wiping member contacts the orifice-disposed face and is moved relatively to the face. As a result, the ink fluid droplets on the orifice-disposed face can be wiped off.

Unfavorable substances such as unnecessary ink fluids that adhere onto the orifice-disposed face are formed by ink mist generated in ejecting ink fluid and the ink fluid rebounding from the recording sheet in the recording operations of the recording head, and paper powder may be supposed to be adhesive onto the recording head when the recording head and paper sheets move relatively to each other in the recording operation.

Even in the ink jet recording apparatus performing the above described various kinds of ejection restoration operations, if the recording head has not been used for ejecting ink fluids for a long period of time, a certain amount of water in the ink fluid may be inevitably evaporated, and the ink fluids may get more viscous. In this case, at the start of recording operations after a long period during which the recording head has not been used, the recording head may bring about an ink ejection failure. So far, in the conventional ink jet recording apparatus, in order to prevent these ink ejection failures described above, it is required that the suction operation be performed at the start of the recording operation, that predetermined restoration procedures are performed in response to the viscosity of the ink fluid, and that ejection restoration operations are required for 5 to 30 seconds before the recording operation can be allowed to start.

The ink ejection failure caused by the viscous ink fluid filled in the recording head which has not been used for the recording operations for so long a period between several days and one year can be resolved only by a single suction restoration operation, and after this operation, the recording head can be used for the recording operation for several days to one week without restoration operations such as a suction operation which require a relatively long time before restarting the recording operation. However, in the case that natural paper sheet is used as a recording medium, prompt drying ink fluids are often used for fixing the ink fluid onto the recording medium and the recording operation is often performed in high temperature and low humidity. In such a case, even by the capping operation with the cap over the recording head, the ink fluid in the recording head is rapidly dried out and the viscosity of the ink fluid may increase in a relatively short period of time. So far, it is required to perform the idle ejection before and during the recording operation in order to prevent the ink ejection failure. In addition, in such an environment, if the period during which the recording head has not been used is so long, the viscous ink fluid cannot be completely removed only by the idle ejection operation.

With respect to the above mentioned problems in the viscous ink fluid, in the conventional ink jet recording apparatus, sealing of the recording head by the cap is fixed more firmly and materials through which the least amount of liquid or vapor penetrate are used for the cap. However, even though these conventional caps are used, the viscous ink fluids cannot be completely prevented, and hence, such a designated ejection restoration operation as a suction operation and so on is required prior to the recording operation.

In case of using a cap having highly hermetical sealing performances, the following problem occurs especially in the portable-type recording apparatus.

1. As the recording head is covered by the cap, due to the pressure variation in the cap caused by vibration and shocks during transportation, the meniscus formed in the ink passage near the orifice falls down inside the ink passage which leads to loss of the ink fluids in the ink passage and may cause the ink ejection failure.

2. Due to the atmospheric temperature change and the recording head temperature change, the air inside the cap may expand or contract, and therefore, there is still a problem that the meniscus falls down inside the ink ink passage and the ink fluid may be leaked out of the orifices by the suction, respectively.

With respect to the above described problem caused by the pressure variation, the ink jet recording apparatus having a cap halfway opened to the atmospheric air, a restoration system and a waste ink tank is proposed to enable to resolve this problem as a patent application by the assignee of the present invention. However, even in this apparatus, the above mentioned problem on the viscous ink fluids cannot be fully prevented.

In addition, as for the reliability of the restoration operations, in case that the gap is formed between the cap and the recording head due to paper powder and dust adhesive onto the cap and the orifice-disposed face of the recording head as described above, the evaporation of the solvent component of the ink fluid is activated further, and as a result, it is supposed that the ink ejection failure may easily occur.

On the other hand, in the ejection restoration operation using the above wiping structure, there are such substances which may remain on the orifice-disposed face such as the ink fluid and paper powders which are not wiped off by the blade. In the case that the ink fluids and so on remain adhered onto the orifice, liquid components of the ink fluid are evaporated and the ink fluid gets more viscous and paper powders adhere to the orifice-disposed face, and therefore, after a long period of time, the solidified ink fluid and paper powders cannot be removed even in the wiping operation with a blade. In the case that the ink fluid contains coloring materials and solvents which have such properties as getting more viscous or crystallization, a phenomena is found that the viscous ink fluid is piled up near the orifice as the evaporation of liquid components in the ink fluid proceeds and that the orifice is covered by the solidified ink fluid, which may lead to ink eject ion failures.

The viscous ink fluid remaining on the orifice-disposed face and the solidified ink fluid piled up near the orifice cannot removed only by the ordinary wiping operation with the blade and the idle ink fluid ejection operation. Prior to the idle ejection operation, even by heating the ink fluid up to an optimum temperature used for the recording operation of the recording head, ink ejection failures may often occur, and hence, in such a case, the viscous ink fluid remaining near the orifice is forced to be evacuated in many of the prior art apparatus. However, in such a case of restoring by the forced evacuation of the ink fluid as a suction operation, some problems are found to be unsolved with respect to scaling-up of the storage means like a waste ink tank in response to the evacuated amount of the ink fluid and reduction of the effective amount of the ink fluid to be used for the recording operation.

SUMMARY OF THE INVENTION

An object of the present invention is to restrict an increase of viscosity of the ink fluid in side the orifice or the ink fluid attaching to the orifice-disposed face and to remove this viscous ink fluid efficiently.

Another object of the present invention is to provide an ink jet recording apparatus which prevents ink ejection failures due to an increase of the viscosity of the ink fluid without any specific restoration processing before recording operations which may arise problems on spending time for preparing recording operations and reserving a space for storing waste ink fluid, and which solves such a problem as ink fluid dropping due to capping operations for the orifice.

Yet another object of the present invention is to provide a method for increasing a wiping performance in an ink jet recording apparatus. That is to establish a good recording condition during a long period and a stable ejection performance of the recording head by reducing or removing efficiently such unfavorable factors arising ink ejection failures as an existence of the viscosity increased ink fluid in side the orifice or on the orifice-disposed face.

In order to attain the above described objectives, in the ejection restoration operations, by means that the viscosity of the ink fluids in the recording head or adhered onto the orifice-disposed face of the recording head is reduced to obtain a higher fluidity by performing the heating operation in the recording heat at the same time, the ejection restoration operations can be performed efficiently.

In addition, by means that the idle ink ejection operation is performed into the cap covering up tightly the recording head and that the inside of the cap is opened to the atmospheric air in this idle ink ejection operation, the inside of the cap is maintained to be humid enough, and at the same time, the pressure variation in the cap is reduced, so that increases in the viscosity of the ink fluid are avoided as well as solving the problems on the falling down of the meniscus of the ink fluid inside the orifice.

The inventors of the present invention studied the method for easily and reliably removing ink which has attached to an orifice—disposed face and has increased in viscosity. The above method is one of the ejection restoration methods for keeping the recording head ejecting ink in a good condition. The inventors found out that the viscosity of ink attached near the orifice is reduced by heating the attaching ink, and that the attaching ink which decreases in viscosity can be removed by cleaning the orifice-disposed face, easily and reliably.

Heating means for increasing the temperature at the orifice-disposed face so as to decrease the viscosity of the attaching ink is described below. The temperature at the orifice-disposed face can be increased by driving the electro-thermal converting element used for ejecting ink to produce heat, or by driving other heating means which is specifically provided. The latter heating means may be formed in the recording head separately in addition to the electro-thermal converting element, or may be provided in the recording apparatus separately. From a view of manufacturing, it is, however, preferable to use the electro-thermal converting element and to control the drive of them in a predetermined manner so as to increase the temperature at the orifice-disposed face.

The heating means described above is also effective for easily expelling ink which has increased its viscosity inside the orifice by an idle ejection (a preliminary ejection), a suction procedure, or the like.

A capping is known as another ejection restoration method for keeping the recording head ejecting ink in a good condition. The inventors also studied a method for covering the orifice-disposed face with a cap securely without producing an adverse effect on an ink ejection by the recording head. There are three cap states in which pressure variations in the cap produce an effect on the ink ejection. First state occurs when the cap covers the orifice-disposed face, second state occurs when the idle ejection is performed during capping, and the third state occurs just when the cap is separated from the orifice-disposed face. The pressure variations in the cap are also affected by variations in the environmental condition. The inventors of the present invention found out that the pressure variations can be moderated by releasing the pressure in the cap outside the cap.

An arrangement for releasing the pressure is such that the cap may be provided with a value so as to balance the pressure in the cap with one of the atmospheric air, or such that an ink discharge path of a suction pump which communicates with an inside of the cap may be used as a pressure releasing path.

This pressure releasing procedure may be controlled in accordance with the atmospheric temperature and the atmospheric humidity which are detected. Each of the above described ejection restoration methods may be individually performed, or may be performed in sequence.

Such sequential procedures will be described below. Firstly, the cap an inside of which communicates with the atmospheric air through a communicating portion is relatively moved to the recording head to contact with the orifice-disposed face so that the face can be covered with the cap, and a sealed space is formed by closing the communicating portion. Next, the idle ejection under a predetermined condition is performed after the inside of the cap (the sealed space) is communicated with the atmospheric air, and then the sealed space is again formed. Before a recording operation, the cap is separated from the recording head after the inside of the cap is communicated with the atmospheric air. After this procedure, the orifice-disposed face is cleaned by wiping with a blade. During this wiping or before this wiping, the electro-thermal converting element is driven in a manner such that ink cannot be ejected, so that ink attaching on the orifice-disposed face is heated. As a result, the viscosity of the attaching ink is reduced so that the attached ink can be easily removed by the wiping. With this wiping procedure involving the heating procedure, a cleaner orifice-disposed surface can be obtained than that obtained by the wiping procedure only.

In the first aspect of the present invention, an ink jet recording apparatus for recording information by ejecting ink fluid on a recording medium comprises:

a recording head having an orifice and for ejecting ink fluid from said orifice;

a cap for covering a face on which the orifice of said recording head is disposed;

an ejection restoration means for keeping a state of ejection of ink fluid by the recording head to be good by discharging ink fluid into the cap;

an opening means for making an inside of the cap opened to an atmospheric air in a restoration operation by the ejection restoration means; and a heating means for heating the recording head at least before the restoration operation is performed by the ejection restoration means.

In the second aspect of the present invention, an ink jet recording apparatus for recording information by ejecting ink fluid on a recording medium comprises:

a recording head for ejecting ink fluid;

an ejection restoration means for keeping a state of ejection of ink fluid by the recording head to be good; and a heating means for heating said recording head at least before a restoration operation is performed by the ejection restoration means.

in the third aspect of the present invention, an ink jet recording apparatus for recording information by ejecting ink fluid on a recording medium comprises:

a recording head having an orifice and for ejecting ink fluid from the orifice;

a cap for covering a face on which the orifice of the recording head is disposed;

an ejection restoration means for keeping a state of ejection of ink fluid by the recording head to be good by discharging ink fluid into the cap; and an opening means for making an inside of the cap opened to an atmospheric air in a restoration operation by the ejection restoration means.

In the fourth aspect of the present invention, an ejection restoration method for a recording head used in an ink jet recording apparatus for recording by ejecting ink fluid on a recording medium comprises:

a step for judging a period of time after an ejection restoration operation by sucking ink fluid from an orifice of the recording head, the restoration operation being performed for keeping a state of ejection of ink fluid by said recording head to be good;

a step for heating the recording head; and a step for performing an ejection restoration operation for keeping a state of ejection of ink fluid by the recording head to be good in responsive to the judgment of the period of time.

The above and other objects, effects, features and advantages of the present invention will become more apparent from the following description of the embodiments thereof taken in conjunction with the accompanying drawings.

BRIEF DESCRIPTION OF THE DRAWINGS

Embodiments of the invention will now be described, by way of example and with reference to the accompanying drawings in which.

DETAILED DESCRIPTION OF PREFERRED EMBODIMENTS

FIRST EMBODIMENT

Figure 1:
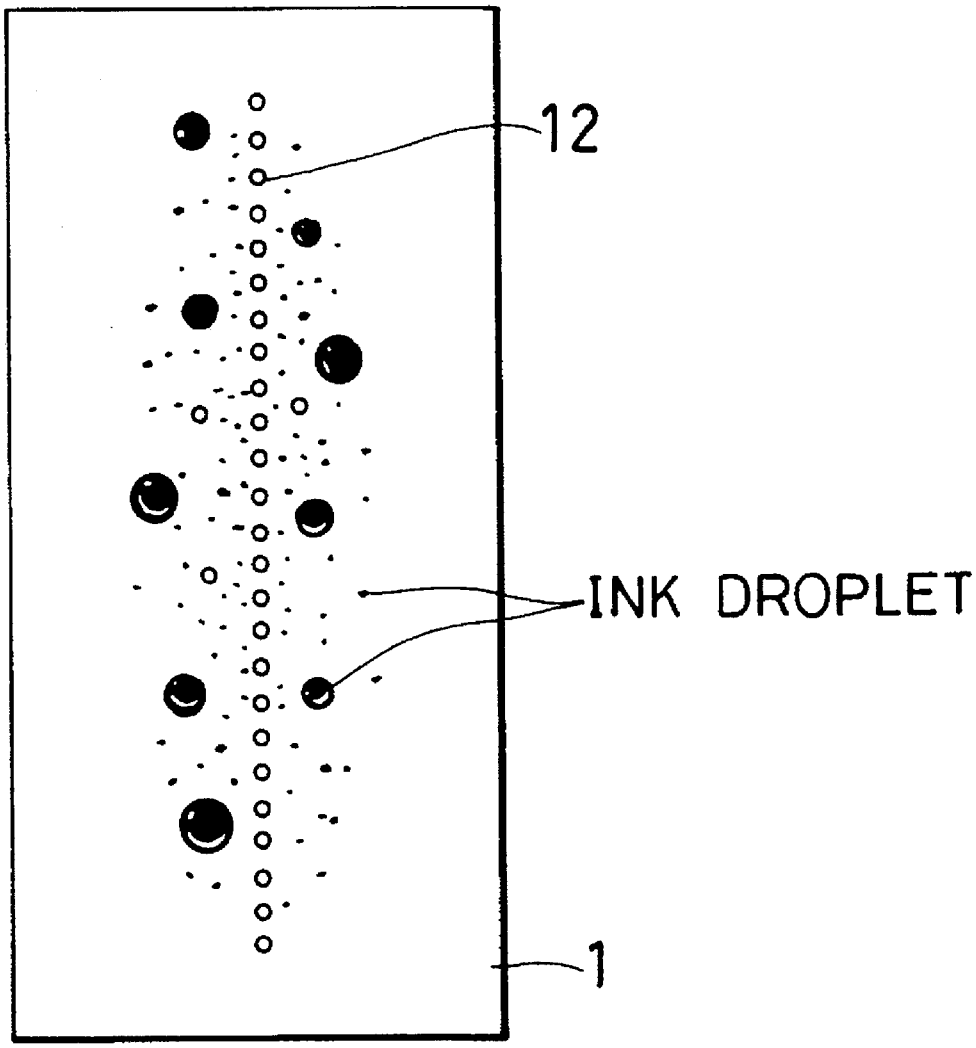
FIG. 1 illustrates a state in which unfavorable substances attach to the orifice-disposed face.
Figure 2:
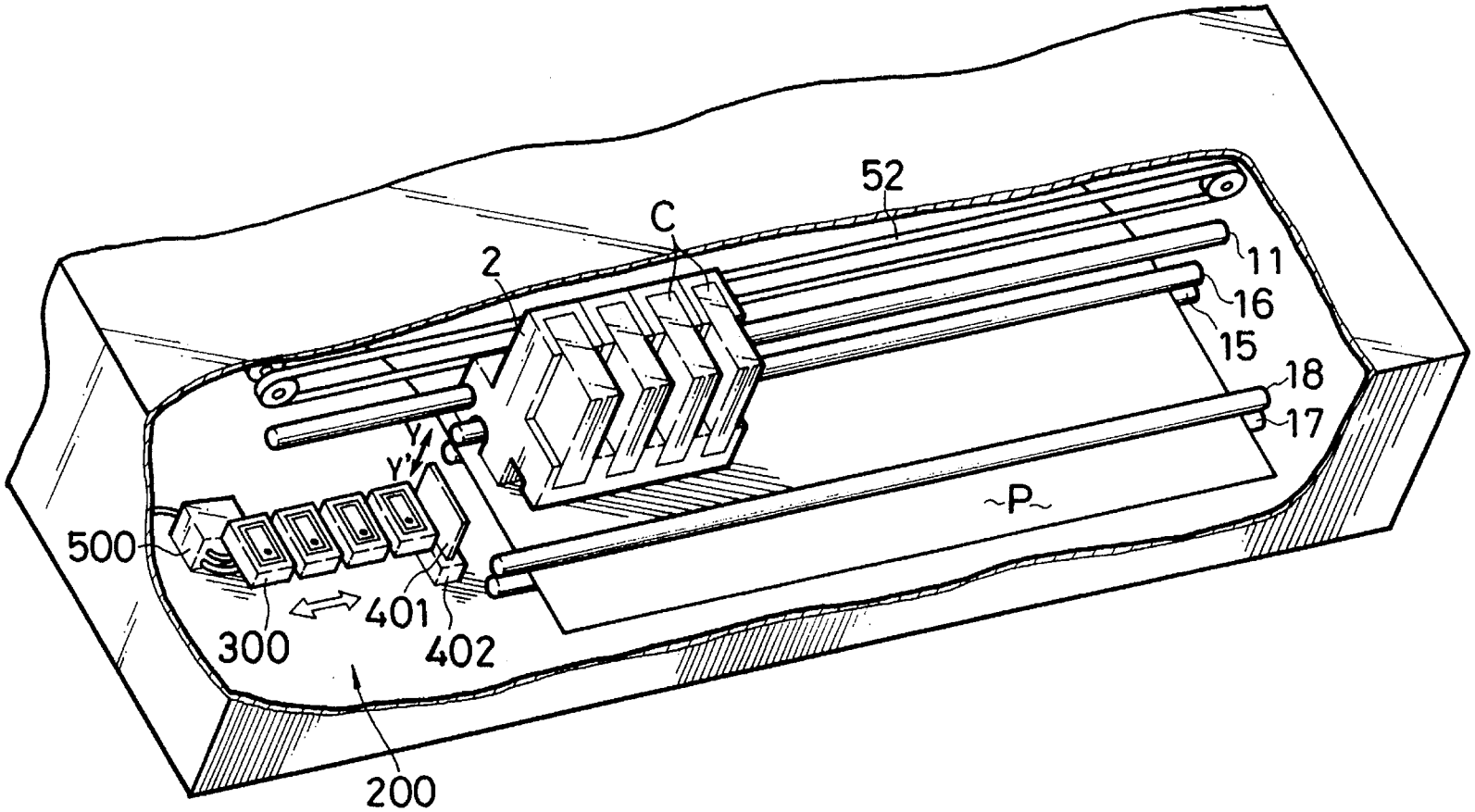
FIG. 2 is a perspective view showing an example of an ink jet recording apparatus to which the present invention can be applied.

FIG. 2 is a schematic view of an ink jet recording apparatus of a first embodiment of the present invention. Component C is an ink jet cartridge, integrally having an ink tank part in the upper side on the figure and a recording head in the lower side on the figure, all assembled in a single unit, and furthermore having a connector for receiving signals for driving a recording head. In this embodiment, the recording head has a plurality of orifices directed downward on the figure, and elements for generating energy used for ejecting ink fluid are placed in the respective ink passage communicated to the orifice. In addition, each of the ink passages is linked to the common fluid reservoir where the ink fluid supplied from the ink tank part is stored. As for the element for generating energy, electro-thermal conversion elements for generating thermal energy are preferable with respect to small-sizing of the orifice and the ink passage.

Component 2 is a carriage having four cartridges C1, C2, C3 and C4 in their designated positions, each of which cartridges corresponds to an individual ink color, for example, yellow, magenta, cyan and black, and having a connector holder for transmitting electric signals for driving recording heads. In the bottom of the carriage 2, as described later, absorbers are installed so that each recording head is placed between adjacent absorbers.

Component 11 is a guide rail extended in the direction in which the carriage 2 moves and supporting the carriage 2 so that the carriage 2 may move freely on the guide rail. Component 52 is a drive belt transmitting a diving force for moving the carriage 2 back and forth on the guide rail 11. A couple of transport rollers 15 and 16, and a couple of transport rollers 17 and 18 are placed at the front of and at the back of the recording area established by the carriage 2, respectively, and used for supporting a recorded medium between them and supplying a transporting force to the recorded medium. Component P is the recording medium, for example, a separated sheet of paper, pressed to a platen, not shown in FIG. 2 in order to define a flat place for recording information on the recording medium. A recording head part of the ink jet recording cartridge C mounted on the carriage 2 is extended downward on the figure from the carriage 2 and placed between the transport rollers 16 and 18 so that an orifice-disposed face of the recording head part may be faced and parallel to the recording medium P pressed to the platen, not shown in FIG. 2.

In the ink jet recording apparatus of this embodiment, a restoration system unit 200 used for a restoration procedure is placed at the home position in the left side FIG. 2. In the restoration system unit 200, component 300 is a cap unit corresponding to each of a plurality of ink jet cartridges having recording heads, and the cap unit 300 can move in the width direction in which the carriage 2 move in response to the movement of the carriage 2 and can rise up or move down in the height direction in accordance with its width direction movement. When the carriage 2 is located at the home position, the cap unit 300 contacts the recording head part and covers up the orifice disposed face of the recording head so that the ink fluid in the orifice of the recording head may not be evaporated, not become more viscous and not congeal to the solid state, all of which lead to ink ejection failures.

Component 500 in the restoration system unit 200 is a pump unit connected to the cap unit 300, which is used for generating a suction force between the cap unit 300 and the recording head, both contacted with each other in the restoration operation so as to evacuate the ink fluid in case of ink ejection failures in the recording head. The pump unit 500 has an opening and shutting mechanism for communicating a part connecting the inside of the cap unit 300 to the atmospheric air. By this structure, when the cap unit 300 caps the recording head, the inside of the cap unit can be closed to the atmospheric air. This structure can be used for the procedure described later in FIG. 10B. In the restoration system unit 200, component 401 is a blade used as a wiping member formed with elastic materials such as rubber, and component 402 is a blade holder for supporting the blade 401. In this embodiment, by means of the blade elevating mechanism driven by the movement of the carriage 2, not shown in FIG. 2, the blade 301 supported by the blade holder 402 can be located at either a wiping position where the blade 401 is moved up and used to wipe off the ink fluids on the orifice-disposed face of the recording head or a waiting position where the blade 401 is moved down so that the blade 401 may not interact with the orifice-disposed face of the recording head.

And furthermore, in this embodiment, the wiping operation by the blade 401 is established only when the carriage 2 is moved from the left side, that is, the home position side where the restoration unit is placed, to the right side on FIG. 2. This is because, as the blade 401 is located between the cap unit 300 and the paper feed part for feeding a recording medium P, in case of wiping the recording head as the blade 401 moves from the right side to the left side, there may be a case that the ink fluid wiped off by the wiping operation is spattered on the paper feed part by the excess elastic force developed by the blade 401 and that the recording medium is stained with ink fluids. If there is no such a case as described above, the wiping operation can be performed in either direction or both directions.

As for the above described wiping operation by the cap unit 300 which moves up and down and side by side for the capping operation and by the blade 401 which moves up and down, and as for regulating the direction in which the blade 401 moves in the wiping operation, for example, a mechanism disclosed in Japanese Patent Application No. 126655/1990 (No. 22878/1989 based on Japanese Patent Priority) can be used. The capping operation and the wiping operation can be established by the combination of driving members such as motors and solenoids for moving up and down the cap unit 300 and the blade 401 and a control means for controlling the driving members.

Figure 3A:
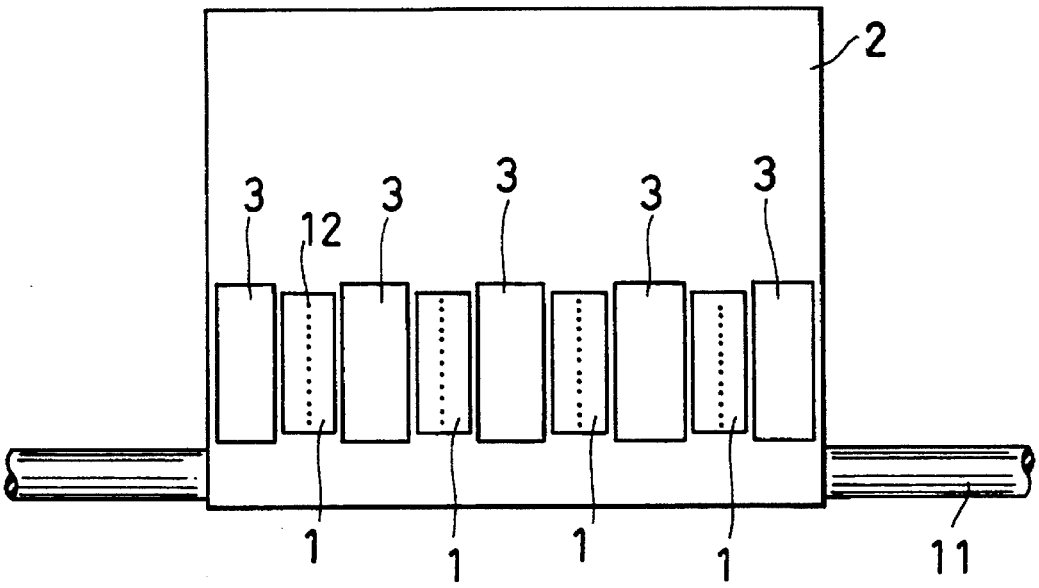
FIGS. 3A and 3B are a bottom view and a plan view of a part around the carriage with the recording head shown in FIG. 2, respectively.
Figure 3B:
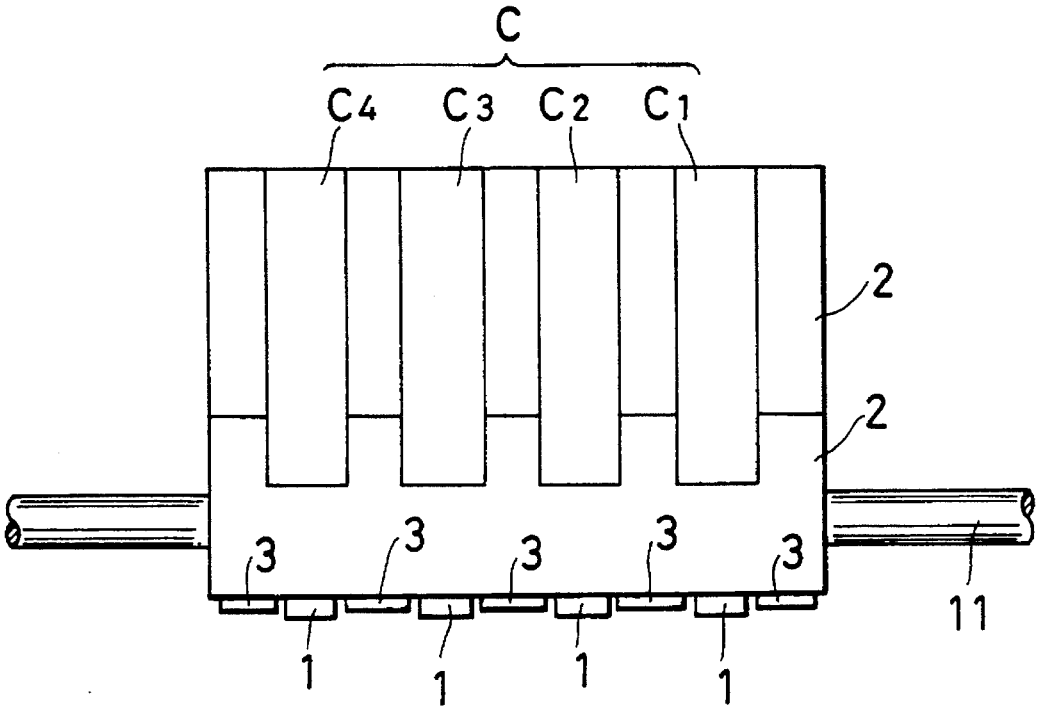

FIG. 3A is a bottom side view of the carriage 2 and FIG. 3B is a front side view of the carriage 2. In these figures, component 1 is an orifice-disposed face and component 12 is the orifice from which ink droplet is ejected. Component 3 is an absorber used for cleaning means for the blade 401 which is composed of porous materials having corrosion-resistant properties against the ink fluid and having highly absorptive properties. The blade cleaning absorber 3 is placed at both sides of the orifice-disposed face 1 of each recording head. As shown in FIG. 3B, in order to prevent the blade cleaning absorber 3 from being rubbed against the recording medium P, the blade cleaning absorber 3 is placed a little inward of the orifice-disposed face 1 of each recording head extended below the bottom surface of the carriage 2. It is desirable that the material used for the blade cleaning absorber 3 is not expanded even if it absorbs the ink fluid in order to prevent the blade cleaning absorber 3 from rubbing on the recording medium.

Wiping Operation

It is generally recognized as described earlier that the face of the recording head in recording images by ejecting ink fluid is moistened by the ink fluid. In case that an excess amount of the ink fluid attaches to the neighboring area of the orifice, ordinary ejection operations of the ink fluid is not fully accomplished: the ejecting direction of the ink fluid is deflected and even the ink fluid cannot be ejected at all. In order to prevent these undesirable and abnormal operations in ejecting ink fluid, it is desirable to wipe off the orifice-disposed face 1 regularly.

Referring to FIG. 4 and FIG. 5, wiping operations in this embodiment is described below.

In FIG. 4, an overall action of the blade 401 in wiping operations is shown, and its magnified view is shown in FIG. 5. As described earlier, wiping operations are performed while the carriage 2 is moved from the home position (the left side on FIGS. 2 and 4) to the recording medium feeding system side (the right side on FIGS. 2 and 4).

Figure 4A:
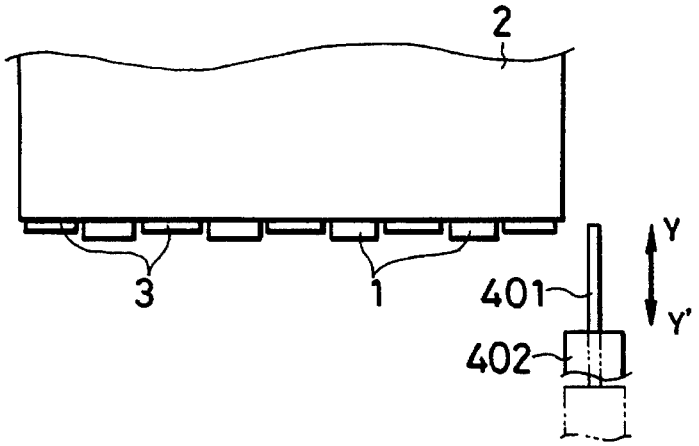
FIGS. 4A, 4B and 4C illustrate wiping operations performed in the recording apparatus shown in FIG. 2.
Figure 4B:
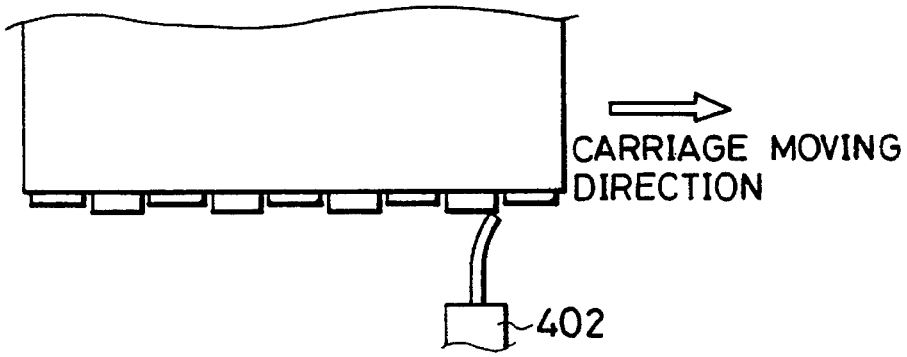
Figure 4C:
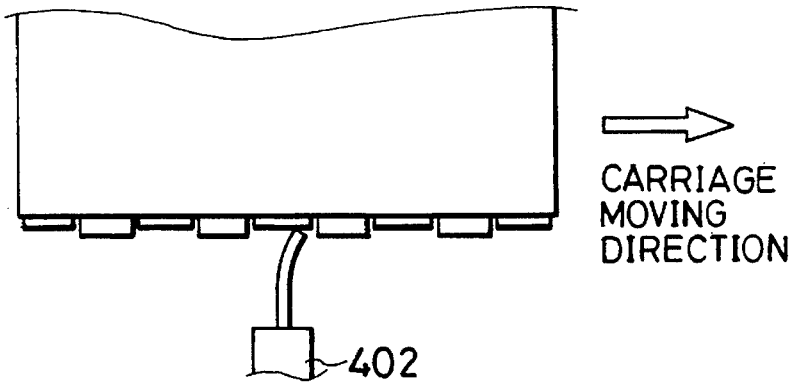
Figure 5A:
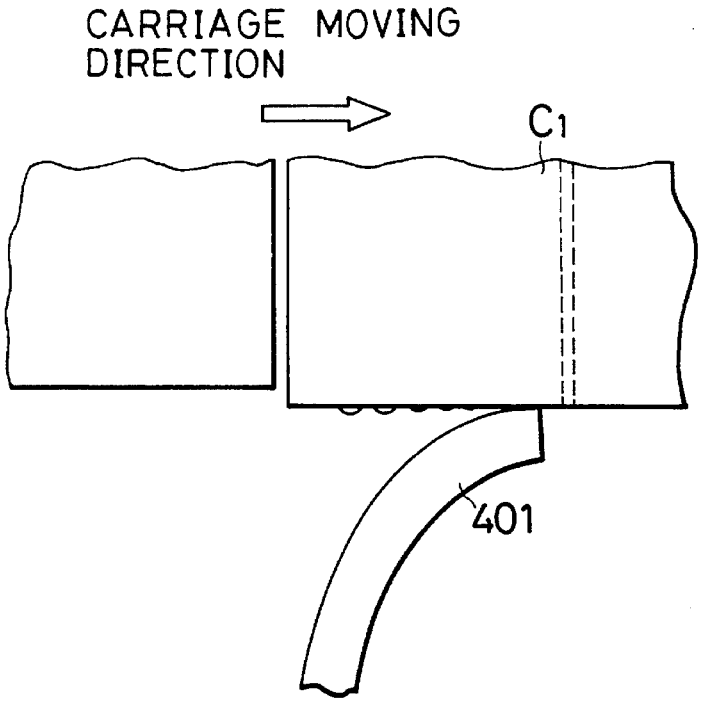
FIGS. 5A and 5B are magnified views of wiping operations shown in FIGS. 4A, 4B and 4C.
Figure 5B:
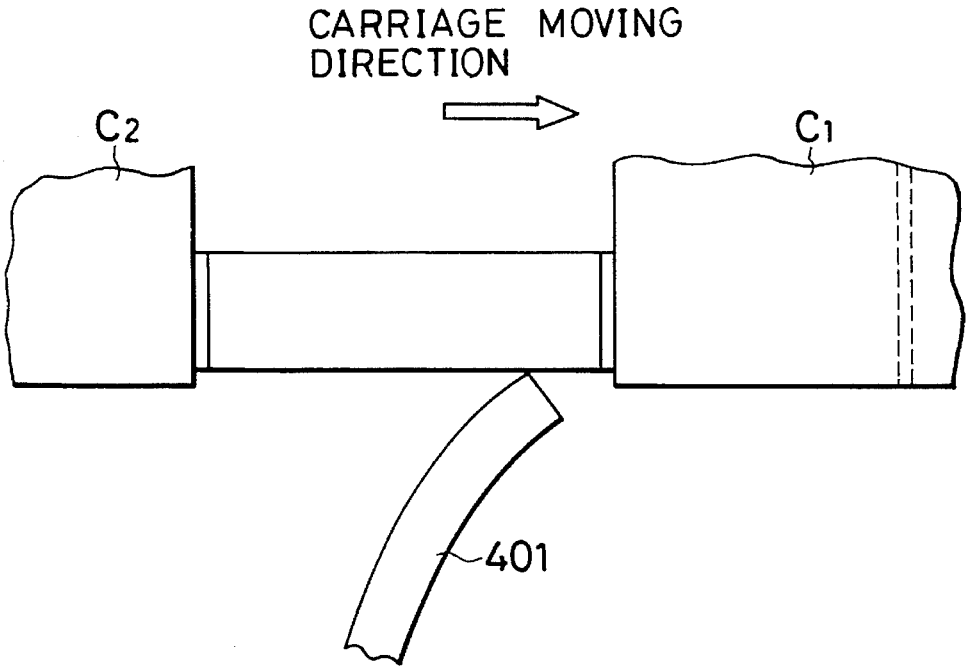

FIG. 4A shows a state of the carriage 2 and the blade 401 at the start of the wiping operations. In this state, the blade 401 get extended in the Y direction defined by the arrow from the waiting position and fixed at a designated position, i.e. a wiping position, where the extended length of the blade 401 is adequate for wiping the recording head. Next, as shown in FIGS. 4B and 4C, as the carriage 2 having the cartridges C is moved horizontally from the left to the right, the blade 401 contacts to alternately the absorbers 3 placed at the bottom face of the carriage 2 and the orifice-disposed face 1 of the recording head extended below the carriage 2, and so far the blade 401 removes the excess ink fluid attached on the orifice-disposed face 1 and also is cleaned by the blade cleaning absorber 3 as shown in FIGS. 5A and 5B. After completing the wiping operation of all the orifice-disposed face 1 and the blade cleaning absorber 3, the blade 401 goes down in the Y' direction and is fixed back to the waiting position. By arranging blade cleaning absorbers 3 between the recording heads, the ink fluid removed from the orifice-disposed face by the blade 401 can be trapped and absorbed by the blade cleaning absorber 3, and hence, the ink fluid remaining on the blade 401 can be reduced so that a great effect may be brought for preventing mixing of ink colors in the next wiping operation of the orifice-disposed face 1 of the recording head using different ink colors.

The speed in moving the carriage 2 for wiping operations is determined by considering the surface wiped by the blade which is defined as the convex and concave shape formed by the orifice-disposed face 1 and the absorber 3, and considering the flexibility of the blade 401 formed as an elastic body. The higher the speed rises up, the less the contact between the blade 401 and the orifice-disposed face 1 or the blade cleaning absorber 3 is established due to the delay in following the shape of the blade 401 to the above convex and concave shape, which leads to the reduction of the effect of removing the excess ink fluid or unfavorable foreign substances, and hence, the speed for wiping operations is preferably taken to be relatively smaller. In this invention, it is found that the speed equal to or less than 300 mm/sec makes no problem.

Control System

Figure 6:
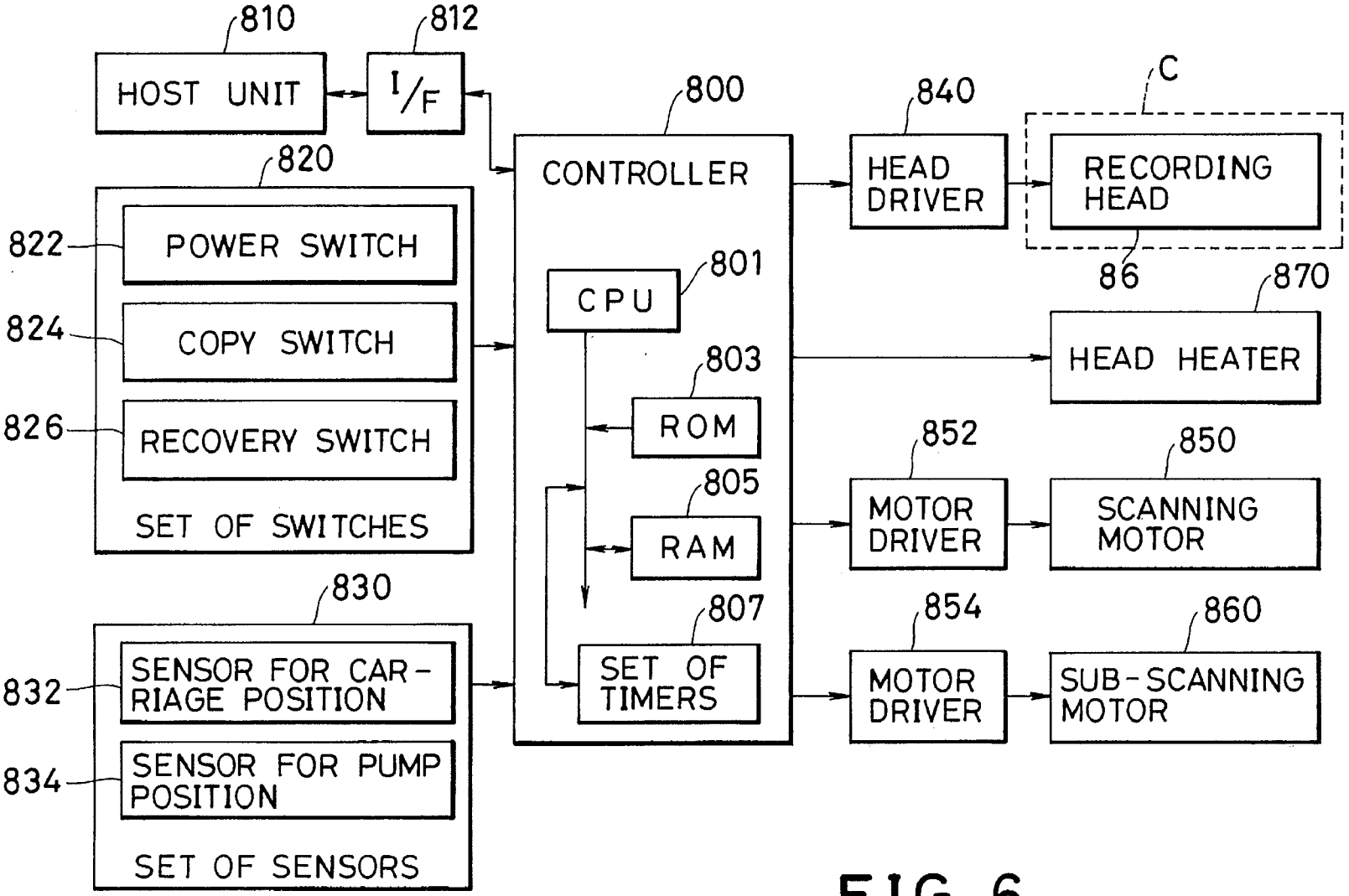
FIG. 6 is a block diagram showing an example of the control system in the ink jet recording apparatus of the first embodiment of the present invention.

FIG. 6 is an example of the structure of the control system in the first embodiment.

Component 800 in FIG. 6 is a controller forming a main part of the controller part, having CPU 801 executing procedures shown in FIGS. 7 to 12, which is realized by, for example, a microcomputer, ROM 803 storing programs correspond to these procedures and other fixed data, and RAM 803 having storages for image data and transaction data. In the controller 800, a set of timers 807 is installed to be used for determining the time for controlling ink ejection restoration procedures in an adequate sequence. Component 810 is a host apparatus such as a reader used for supplying image data, and image data as well as control commands and status reporting signals are transmitted through an interface I/F 812 between the host apparatus and the controller 800.

A set of switches 820 include a power switch 822, a copy switch 824 for requesting the start of recording information, and a restoration switch 826 for requesting the start of the ink ejection restoration operations, all of which accept the input requests by the user. A set of sensors 830 is used for detecting various states of the apparatus, including a sensor 832 for detecting the position of the carriage 2 at the home position or the start position, and a sensor 834 for detecting the position of the suction pump.

Component 840 is a head driver for driving elements, electro-thermal conversion elements in this embodiment, which is disposed in the recording head 86 of the cartridge C and is used for generating energy so as to eject ink fluid. Component 850 is a main scanning motor for moving the carriage 2 in the main scanning direction (the width direction on FIG. 2), component 852 is a driver for the main scanning motor 850. Component 860 is a sub scanning motor for rotating the rollers 15, 16 and 17, 18 (shown in FIG. 2) so as to transport the recording medium and component 862 is its driver.

Component 870 is a head heater for heating the recording head, which can be realized as a single unit formed together with the recording head or a separate unit formed on the substrate on which an electro-thermal conversion element is developed in an identical fabrication process to both. The heater 870 may be installed in the carriage 2, in which the installation position in the carriage is so determined as to establish an effective heat transmission by contacting the heater 870 to the recording head 86 in installing the head unit into the cartridge.

Ejection Restoration Mode

In the following, various kinds of ejection restoration modes used in the apparatus of this embodiment are described.

(a) Ejection Restoration Mode defined by recovery switch 826

The objective of this restoration mode is to restore the ejection power of the recording head into a normal condition at the time when the operator turns on or pushes the recovery switch 826 by considering that the ejection operation of the recording head is not normally performed in spite that the scheduled restoration operations is completed automatically in the apparatus of this embodiment. Although this mode is not used in ordinary operation conditions, if it is used, is taken to be larger than that of other modes.

In this mode, the ink fluid getting more viscous and bubbles in the common fluid reservoir or the ink passage can be removed by sucking by the pump 500. In addition, by driving the electro-thermal conversion element to eject ink fluid at the same time as driving the pump 500 for sucking the ink fluid, adding the pressure generated by the pump 500 and the pressure developed instantaneously by growth and contraction bubble induced by the electro-thermal conversion element, bubbles in the common fluid reservoir or the ink passages can be efficiently removed. And furthermore, as the electro-thermal conversion element is driven for generating the bubble for ejecting ink fluid so that the temperature of the ink fluid in the ink passages increases and hence, the viscosity and the surface tension of the ink fluid are reduced and the impedance of the ink passage is reduced, bubbles in the ink passage can be easily removed. Parameters for the restoration mode are determined depending on the number of orifices, dimensions of components of the recording head and the viscosity of the ink fluid. In this embodiment, the suction pressure is defined by the maximum pressure developed by the pump 500, the duration time for sucking operation is 2.5 sec and the amount of ink fluid to be sucked is about 0.17 g.

After the sucking operation, the orifice-disposed face of the recording head is wiped by the rubber blade and an idle ejection of the ink fluid is performed.

(b) Ejection Restoration Mode using Timer Suction

The objective of this mode is to prevent the case that the ejection power of the recording head is not in a normal condition due to an increase of the viscosity of the ink fluid and the growth of bubbles generated in the common fluid reservoir in the recording head after a long period passed during which the restoration operation has not been performed. In this mode, the next restoration operation is performed at a designated time, which is defined by the timer installed in the controller, after the previous restoration operation was performed.

In this mode, the ink fluid getting more viscous and bubbles in the common fluid reservoir or the ink passage can be removed by sucking by the pump.

After the sucking operation, the orifice-disposed face of the recording head is wiped by the blade 401 and the idle ejection of the ink fluid is performed.

(c) Ejection Restoration Mode using Counter

The objective of this mode is to prevent the case that the ejection power of the recording head is not in a normal condition due to an increase of the viscosity of the ink fluid and the growth of bubbles generated in the common fluid reservoir in the recording head after a long period passed during which the restoration operation has not been performed and the information recording operation has been long continued. In this mode, the next restoration operation is performed at the time when the number of recorded separated sheets reaches a designated number while counting the number of recorded separated sheets by the counter after the previous restoration operation was performed.

This mode is similar to the above described mode using timer suction restoration where the ink fluid getting more viscous and bubbles in the common fluid reservoir or the ink passages can be removed by sucking by the pump, and after the sucking operation, the orifice-disposed face of the recording head is wiped by the blade 401 and the idle ejection of the ink fluid is performed. So far, the timer and the counter are initialized when the timer suction restoration by the previous mode or the counter suction restoration by this mode is performed.

(d) Preliminary Ejection (A) Mode

In this preliminary ejection mode, the idle ejection of the ink fluids from all the orifices is performed every time before the recording operation, when stopping the recording operation, after waiting for the next recording operation and when the wiping operation. In this mode, in order to obtain stable conditions for ejecting ink fluid without making the temperature of ink in the ink passage increase, for example, the driving frequency of the electro-thermal conversion element is taken to be 1KHz in response to the maximum driving frequency 4 KHz of the electro-thermal conversion element.

(e) Preliminary Ejection (B) Mode

In this preliminary ejection operation, the ink fluids are ejected out of all the orifices at the same time as the sucking operation is performed. In this mode, the driving frequency of the electrothermal conversion element is taken to be 4 KHz equivalent to the maximum driving frequency of the electro-thermal conversion element so that the temperature of the ink passage may be made to be higher, that the viscosity of the ink fluid may be reduced and that the discharged velocity of the ink fluid in the ink passage may be made to be higher by using the ejection energy.

(f) Preliminary Ejection (C) Mode

This preliminary ejection operation is performed in case that there are more viscous ink fluids on the orifice-disposed face or near the orifice. After a preliminary heating (B) mode described later, the electro-thermal conversion element is driven with its maximum driving frequency in the ejection operation. In this mode, the driving frequency of the electrothermal conversion element is taken to be 4 KHz equivalent to the maximum driving frequency of the electro-thermal conversion element so that the temperature of the electro-thermal conversion element may be made to be higher and that the viscosity of he ink fluid may be reduced in order to establish an easy discharge operation of ink fluid.

(g) Recording Head Heating Mode

The recording head heating mode is for maintaining the temperature of the recording head 86 to be a desirable value for ejecting ink fluid by using the heater 870 installed differently from the electro-thermal conversion element as a heater used for ejecting ink fluid. This mode is performed at the time when the recording operation is performed or when the recording head is waiting for the next recording operation at a designated timing, that is, at a standby timing.

(h) Preliminary Heating (A) Mode

This preliminary heating operation is performed before a preliminary ejection operation to be performed in the case that the recording head is not operated during a designated period. In this mode, making the heater (the electro-thermal conversion element) used for ejecting ink fluid generate thermal energy small enough not to eject ink fluid, the temperature of the ink fluid in the ink passage is raised up to a desirable value for the ejection operation. The reason why the heaters for ejecting ink fluid are used in this mode is that the heater for ejecting ink fluid directly contacts the ink fluid in the ink passage and hence heating of the ink fluid can be efficiently and promptly performed. The heater 870 installed differently from the heaters for ejecting ink fluid may be used in this mode. Principally, the temperature of the ink fluid is controlled to be the same value as that in the recording head heating mode.

(i) Preliminary Heating (B) Mode

This preliminary heating operation is performed before the wiping operation or the preliminary ejection (C) mode operation to be performed after the recording head is not operated during a designated period. In this mode, making the heater for ejecting ink fluid generate thermal energy small enough not to eject ink fluid, the temperature of the ink fluid in the ink passage is raised up to a desirable value for the ejection operation. The reason why the heater for ejecting the ink fluid is used in this mode is that the heater for ejecting ink fluid directly contacts the ink fluid in the ink passage and hence heating of the ink fluid can be efficiently and promptly performed. The heater 870 installed differently from the heaters for ejecting the ink fluid may be used in this mode.

Restoration Control Procedures in the Recording Apparatus

Restoration control procedures using selectively the above mentioned modes are described in the following.

Figure 7A:
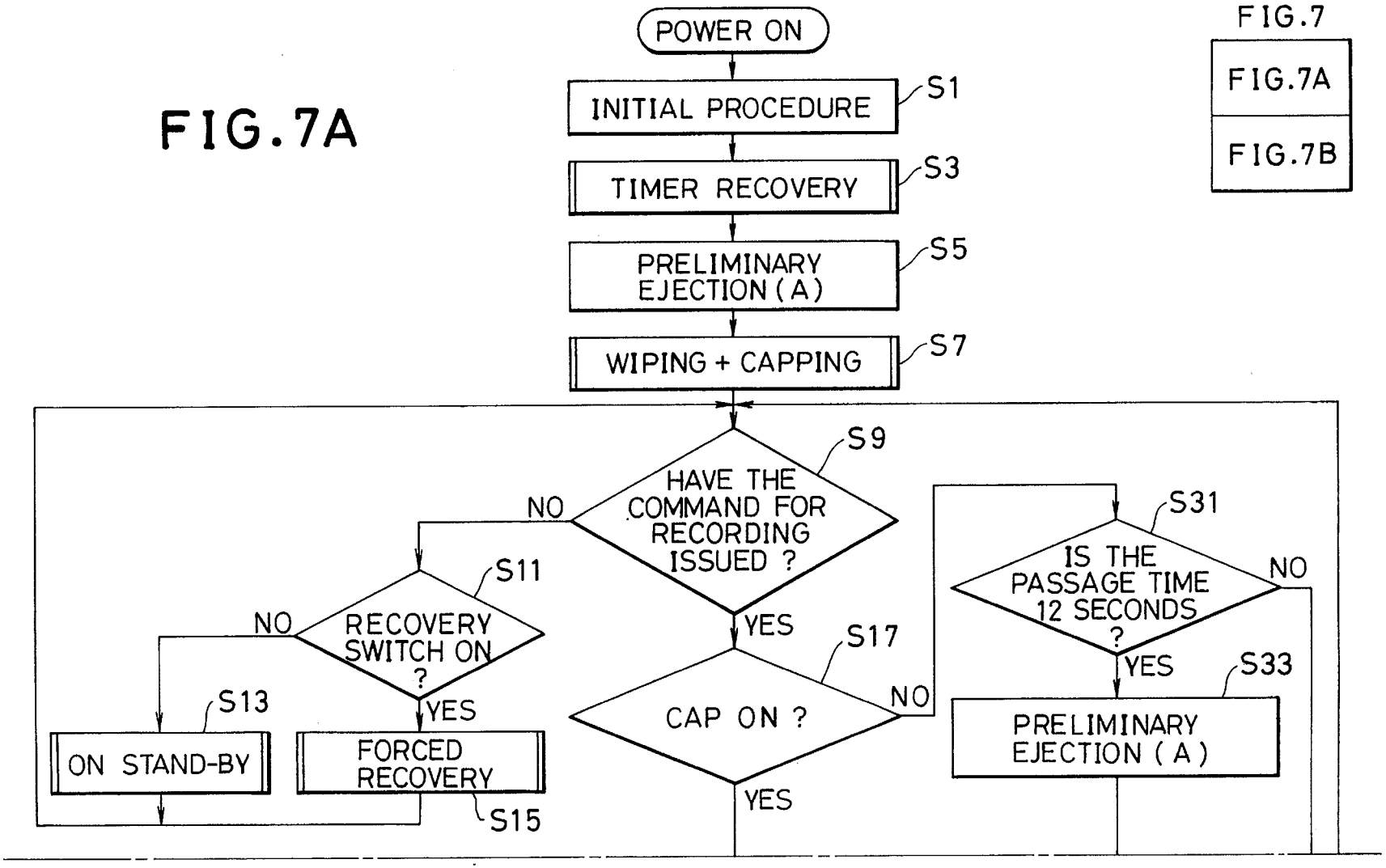
FIG. 7 represents the composite of FIGS. 7A and 7B which are flow charts showing an example of the recording control procedures in the ink jet recording apparatus of first embodiment of the present invention.
Figure 7B:
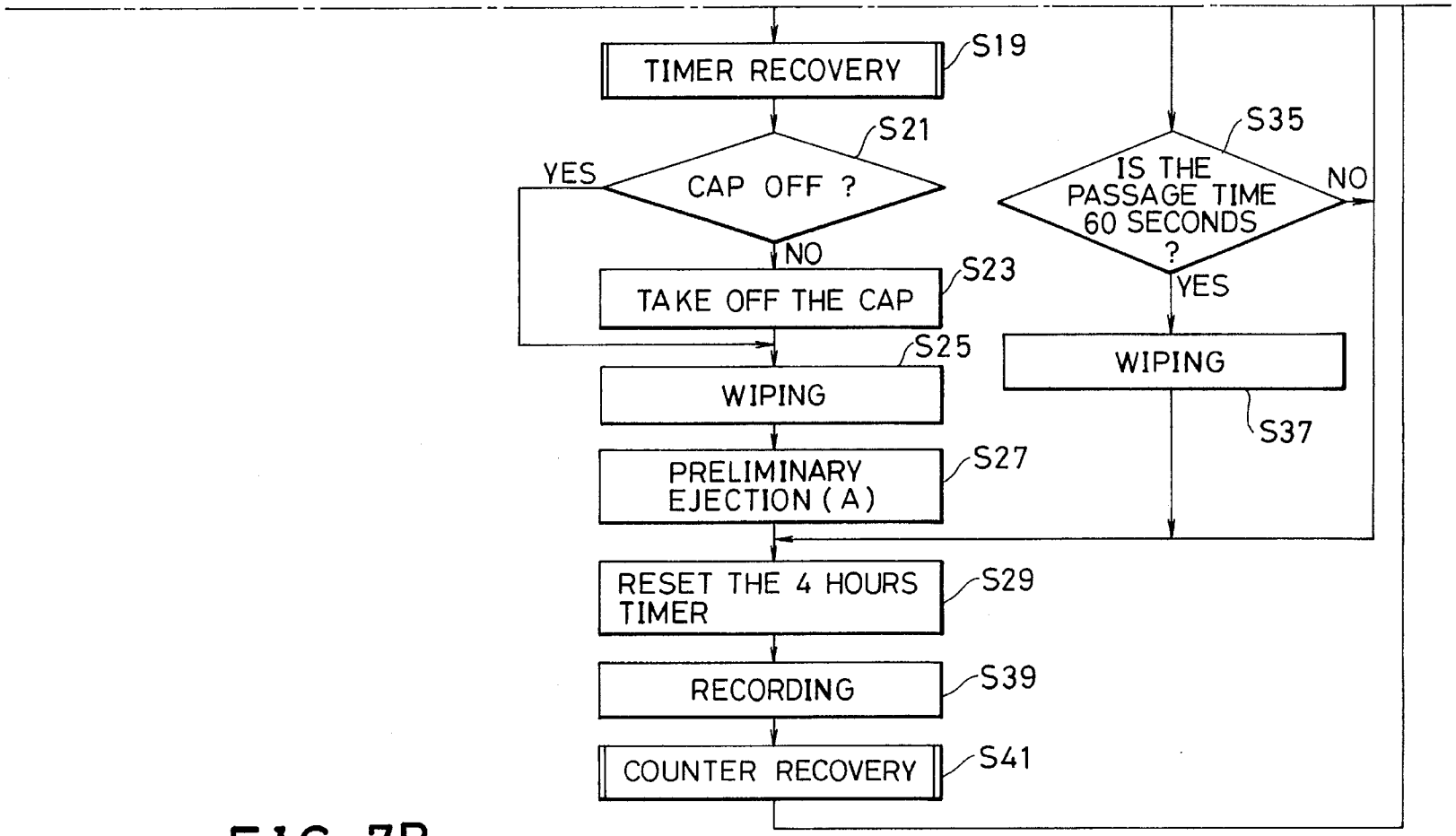

FIGS. 7A and 7B are examples of main control procedures of the ink jet recording apparatus, where restoration procedures are mainly described.

In step S1, when the power switch 822 is turned on, the ink jet recording apparatus of this embodiment at first checks each part of the apparatus such as ROM 803 and ROM 805 and so on as an initial check of the recording apparatus itself.

Figure 8:
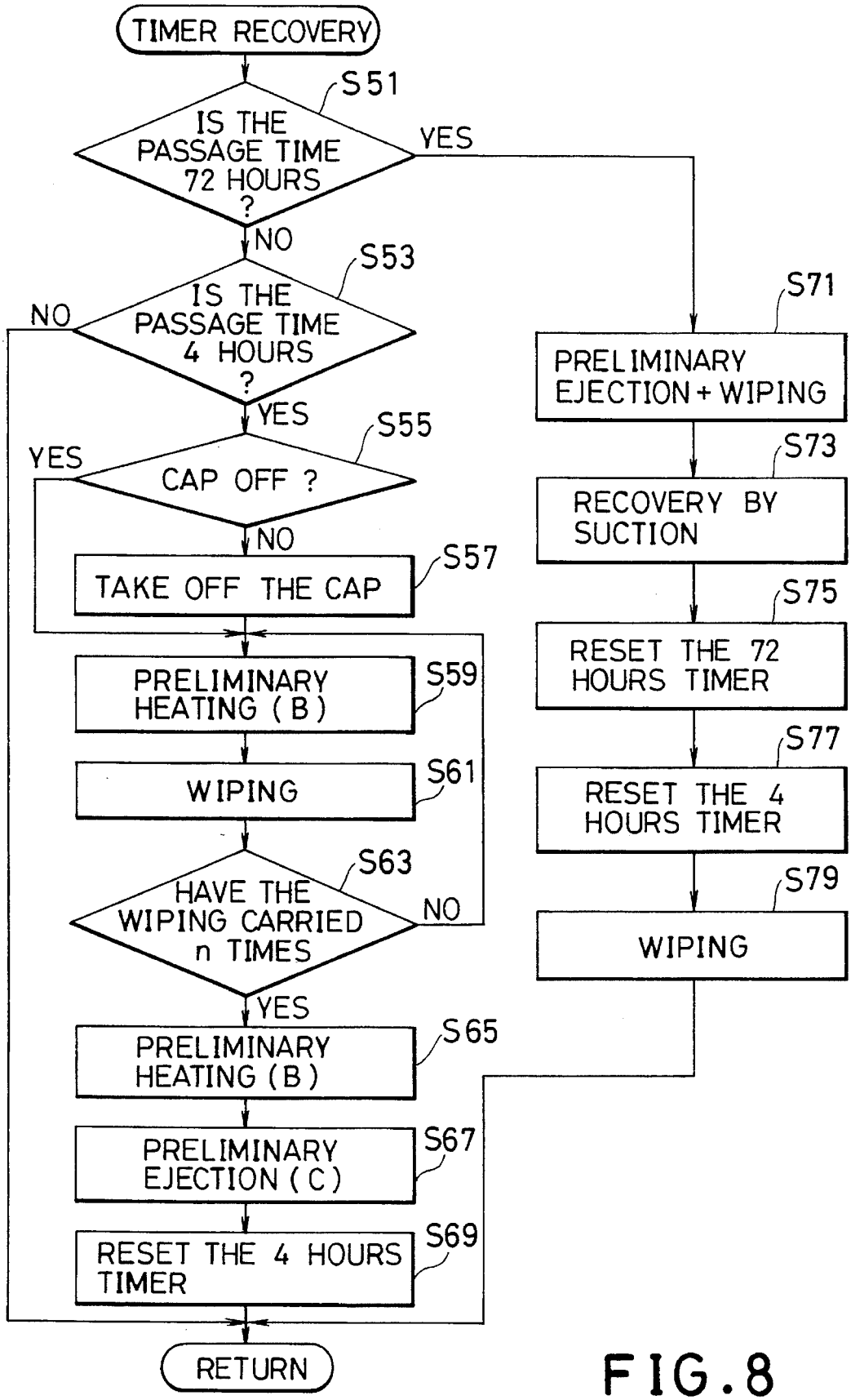
FIG. 8 is a flow chart showing an example of the timer restoration procedure in the procedures shown in FIGS. 7A and 7B.

Next, in step S3, a restoration operation by timer recovery procedures to be described later with FIG. 8 is performed, and then, in step S5, a preliminary ejection (A) mode described above is performed. In this timer recovery procedures, there may be a case that the ejection restoration mode using timer suction or a viscous ink fluid removing operation is included.

Figure 9:
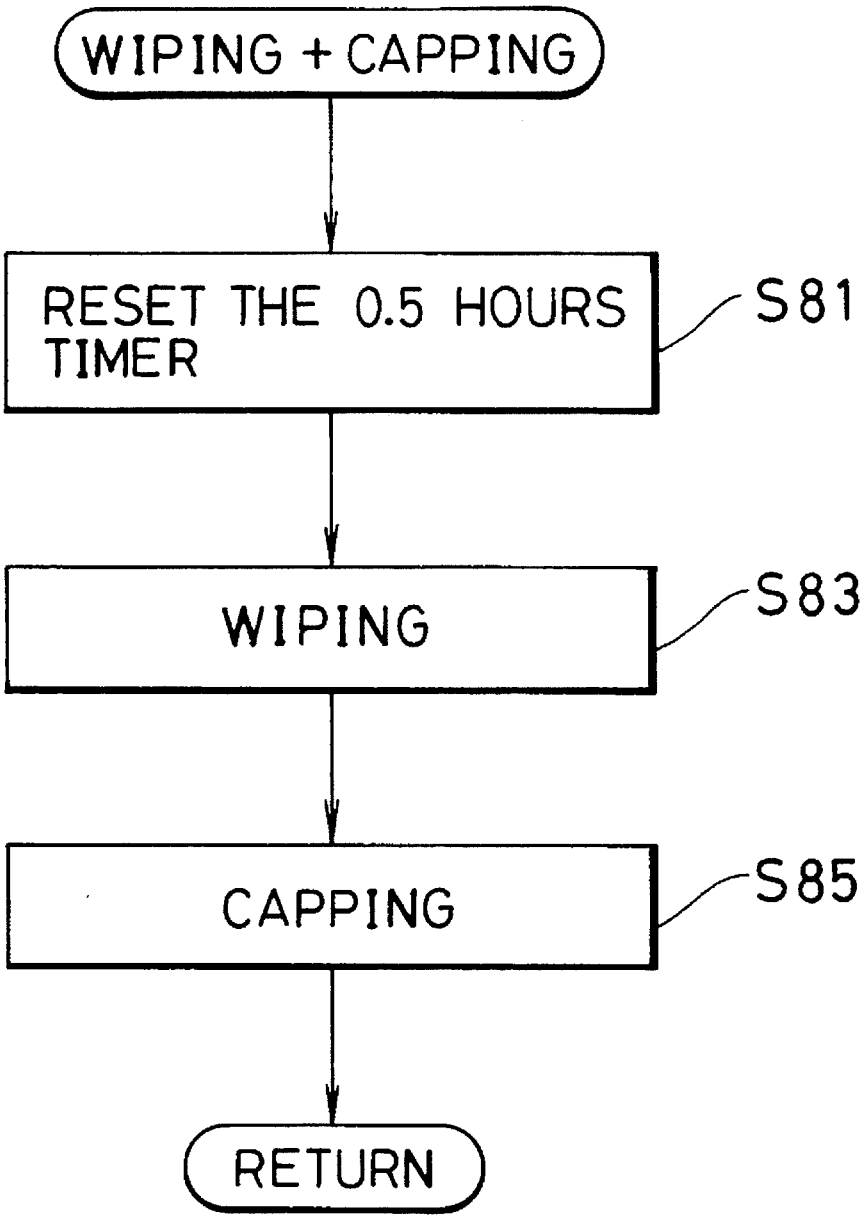
FIG. 9 is a flow chart showing an example of the wiping operation and the capping procedure in the procedures shown in FIGS. 7A and 7B.
Figure 10A:
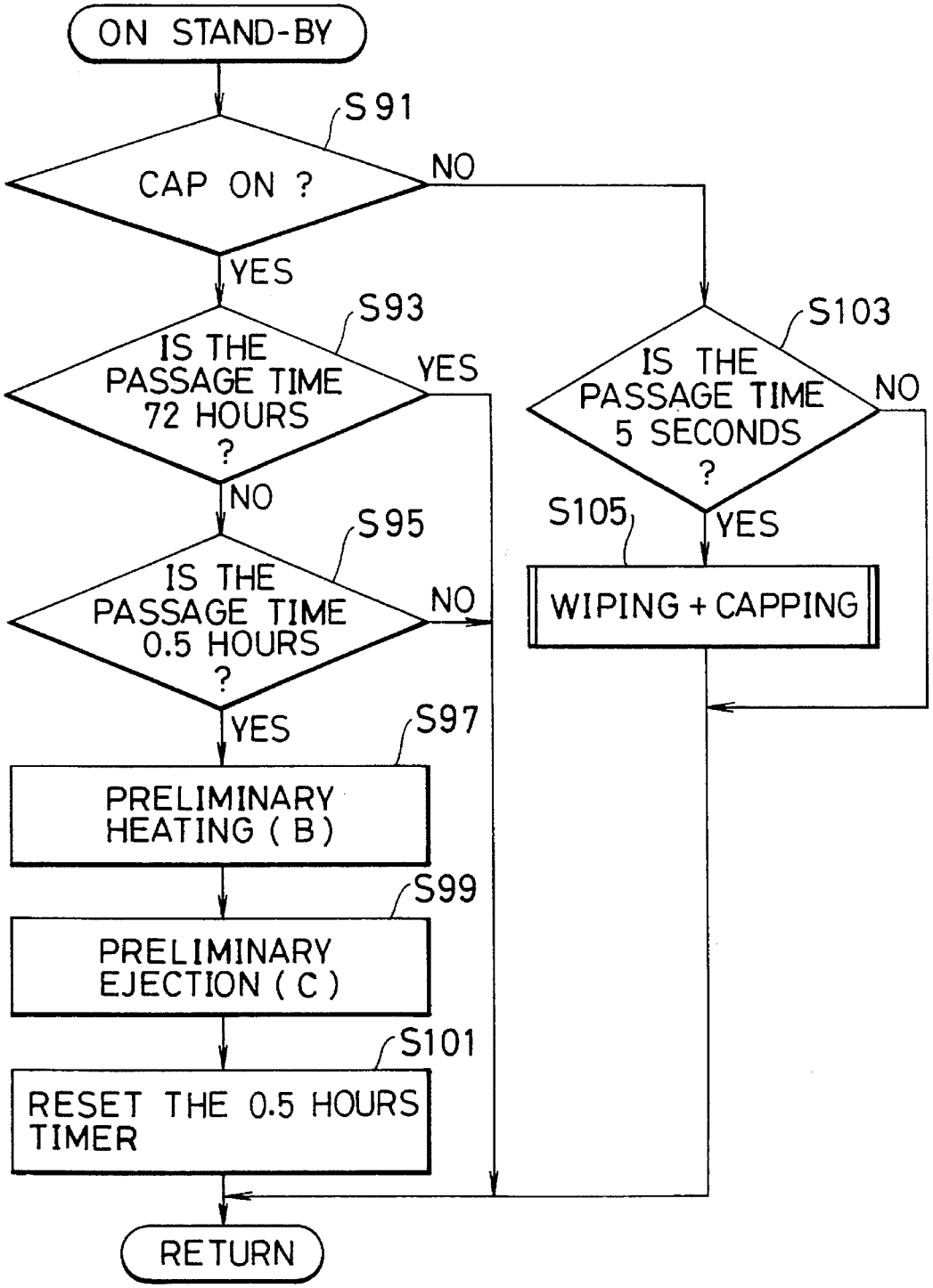
FIGS. 10A and 10B are flow charts showing two examples of the standby procedures in the procedures shown in FIGS. 7A and 7B.
Figure 10B:
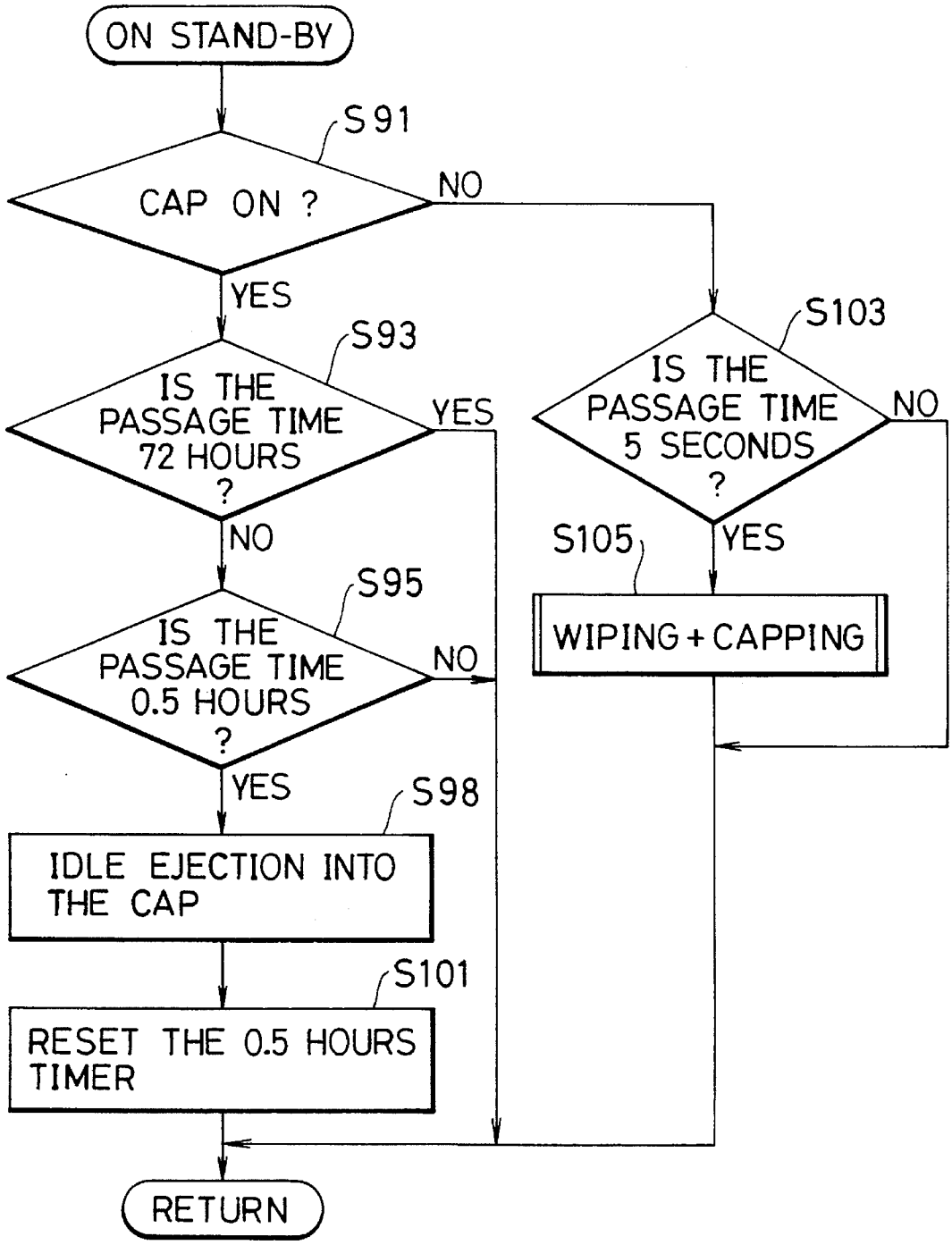

After step S5, wiping and capping operations to be described later with FIG. 9 are performed in step S7, and in step S9, the recording apparatus waits for the signal requesting to start the recording operation. If step S9 detects no signal for requesting to start the recording operation, step S11 is selected for judging whether the restoration switch 826 is turned on or not. If step S11 concludes that the recovery switch 826 is not turned on, step S13 for the standby procedure to be described later with FIGS. 10A and 10B is selected next, and if the recovery switch 826 is turned on, step S15 is selected to perform the forced restoration procedure to be described later with FIG. 11.

On the other hand, if step S9 detect a signal for requesting to start the recording operation, step S17 is selected for judging whether the cap is closed, that is, the cap is on, or not. If the cap is on, the timer recovery procedure is performed in step S19 to be described later with FIG. 8, and consequently in steps S21 and S23, the cap is removed if the cap is not off. After step S23, step S25 for the wiping operation and step S27 for the above mentioned preliminary ejection (A) mode operation are followed and step S29 is reached.

If step S17 judges that the cap is opened, step S31 is selected next and whether a designated time, for example, 12 seconds, has passed or not after the cap is opened. If step 31 derives a negative conclusion, step S29 is selected directly. If step 31 concludes that a designated time has passed, the preliminary ejection (A) mode operation is performed in step S33 and, in step S35, whether a designated time, for example, 60 seconds, has passed or not after the cap is opened, is judged. If step S35 gives a negative conclusion, step S29 is reached. If not so, the wiping operation is performed in step S37 before reaching step S29.

Figure 12:
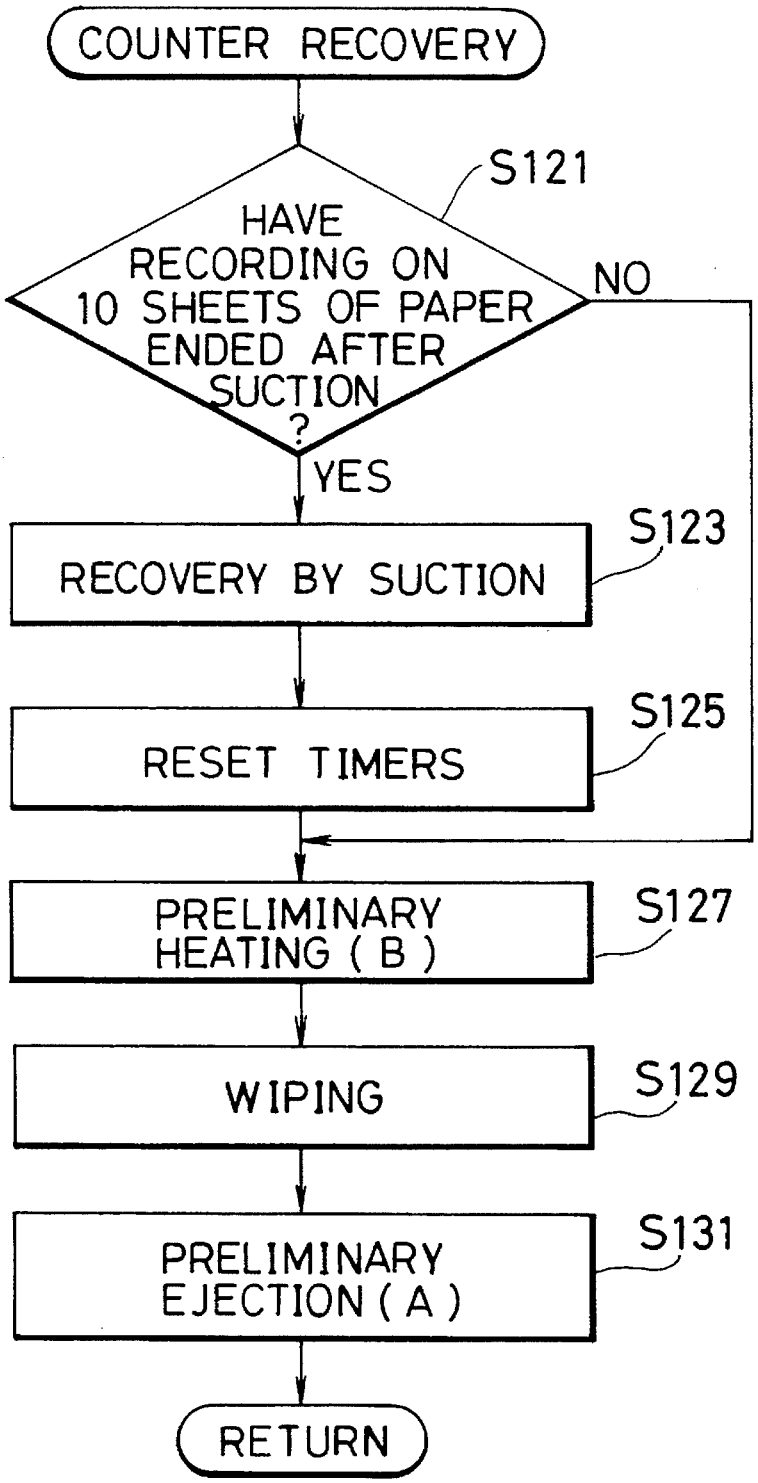
FIG. 12 is a flow chart showing an example of the counter restoration procedure in the procedures shown in FIGS. 7A and 7B.

In step S29, initialized is a timer for counting a designated period of time, 4 hours, is one of timers used for an adequate restoration procedure in responsive to a designated timing. This timer is designated as a 4-Hr timer. After step S29, the recording operation is performed in step S39. After step S39, the counter restoration procedure to be described later with FIG. 12 is performed in step 41, and step S9 is reached again for detecting a signal for requesting to start the recording operation. In step S41 for the counter restoration procedure, the ejection restoration mode using counter may be included.

FIG. 8 shows an example of the timer recovery procedures executed in steps S3 and S19. In step S51, using a timer counting a relatively long period of time, for example, 72 hours, which is one of the timers used for the restoration operation and is designated as a 72-Hr timer, judged is whether 72 hours have passed or not since the previous restoration operation by sucking ink fluid was made. If step S51 derives a negative conclusion, step S53 is selected as the next step for judging whether 4 hours have passed or not since the previous preliminary ejection operation and the previous wiping operation. If step S53 derives a negative conclusion, this timer recovery procedures are terminated, and if not so, after making the cap off in steps S55 and S57, the viscous ink fluid removing operation to be described below is performed in steps from S59 to S69.

In case that there are such substances remaining on the orifice-disposed face as the ink fluid and paper powders which are not wiped off by the blade, liquid components of the ink fluid are evaporated and the ink fluid gets more viscous and the paper powders adhere to the orifice-disposed face, and therefore, after a long period of time, the solidified ink fluid and paper powders cannot be removed even in the wiping operation by the blade. In case that the ink fluid contains coloring materials and solvents which have such properties as getting more viscous or crystallization, a phenomena is found that the viscous ink fluid is piled up near the orifice as the evaporation of liquid components in the ink fluid proceeds and that the orifice is covered by the solidified ink fluid, which may lead to ink ejection failures.

The viscous ink fluid remaining on the orifice-disposed face and the solidified ink fluid piled up near the orifice cannot be removed only by the ordinary wiping operation by the blade and the preliminary ejection operation. Prior to the preliminary ejection operation, even by heating the ink fluid up to an optimum temperature used for the recording operation of the recording head, ink ejection failures may often occur, and hence, in such a case, the viscous ink fluid remaining near the orifice was forced to be discharged by sucking operation in many of the prior art apparatuses.

In contrast to the above described prior art apparatus, in the present invention, it is attempted that the viscous ink fluid be removed efficiently without consuming too much ink fluid used for the forced discharging. In this embodiment, in case that a relatively long time, e.g. 72 hours, has not passed since the previous sucking operation, the restoration operation is realized by the wiping operation defined by step S61. Prior to this wiping operation by step S61, the preliminary heating (B) mode is performed in step S59 for heating the orifice of the recording head and its neighboring area on the orifice-disposed face.

The viscous ink fluid is heated up by the preliminary heating (B) mode and the viscosity of the ink fluid is reduced so that the ink fluid may be removed easily by the wiping operation. The solidified ink fluid piled up near the orifice is gradually softened by the preliminary heating (B) mode and can be removed easily by the wiping operation even if the whole part of the solidified ink fluid is not fully softened. Although almost whole parts of the viscous and solidified ink fluid can be removed from the orifice-disposed face, there may be a case that the viscous or solidified ink fluid cannot be removed only by a single wiping operation or a case that the ink fluid which is not fully softened may be remained on the orifice-disposed face and near the orifice. In order to cope with such cases, in this embodiment, a plurality of sets of operations of the preliminary heating (B) mode and the wiping operation are performed n times in a repetitive manner controlled by step S63. It is allowed that only the wiping operation is repeated.

In the wiping operation after the preliminary heating mode, a part of the viscous ink fluid removed from the orifice-disposed face may be filled again into the orifice, which still leads to ink ejection failure. In this embodiment, additive operations for the preliminary heating (B) mode and the preliminary ejection (C) mode are performed in steps S65 and S67 again immediately after step S63, followed by step S69 for reset of the 4-Hr timer before going back to the main routine shown in FIG. 7.

As the objective of the preliminary heating (B) mode for making it easier to wipe off and eject the viscous ink fluid is to make lower the viscosity of the ink fluid with its components partially evaporated, the temperature for the preliminary heating (B) mode is selected to be greater than the temperature of the preliminary heating (A) mode or the recording head heating mode for establishing a stable ejection performance of the recording head.

In this embodiment, whether the preliminary heating mode is required or not before the wiping operation is determined by the period of time during which the recording head is not operated for ejecting ink fluid. By using the 4-Hr timer measuring the time passed since the latest preliminary ejection and wiping operations, the preliminary heating mode is performed only if four hours have passed since the latest preliminary ejection and wiping operations was completed when the power switch is turned on or the recording operation starts. So far, in recording information continuously, the preliminary heating operation is not performed, and hence the processing time is not wasted if this operation is not necessary. However, as it is recognized that the preliminary heating operation is effective for removing the ink fluid attaching to the orifice-disposed face during the recording operation, it is allowed that the preliminary heating operation can be performed prior to the wiping operation immediately after the recording operation. In this case, as the ink fluid is supposed not to be getting more viscous, the temperature for the heating operation of this case may be taken to be lower than the temperature used in the above described restoration operations.

Figure 11:
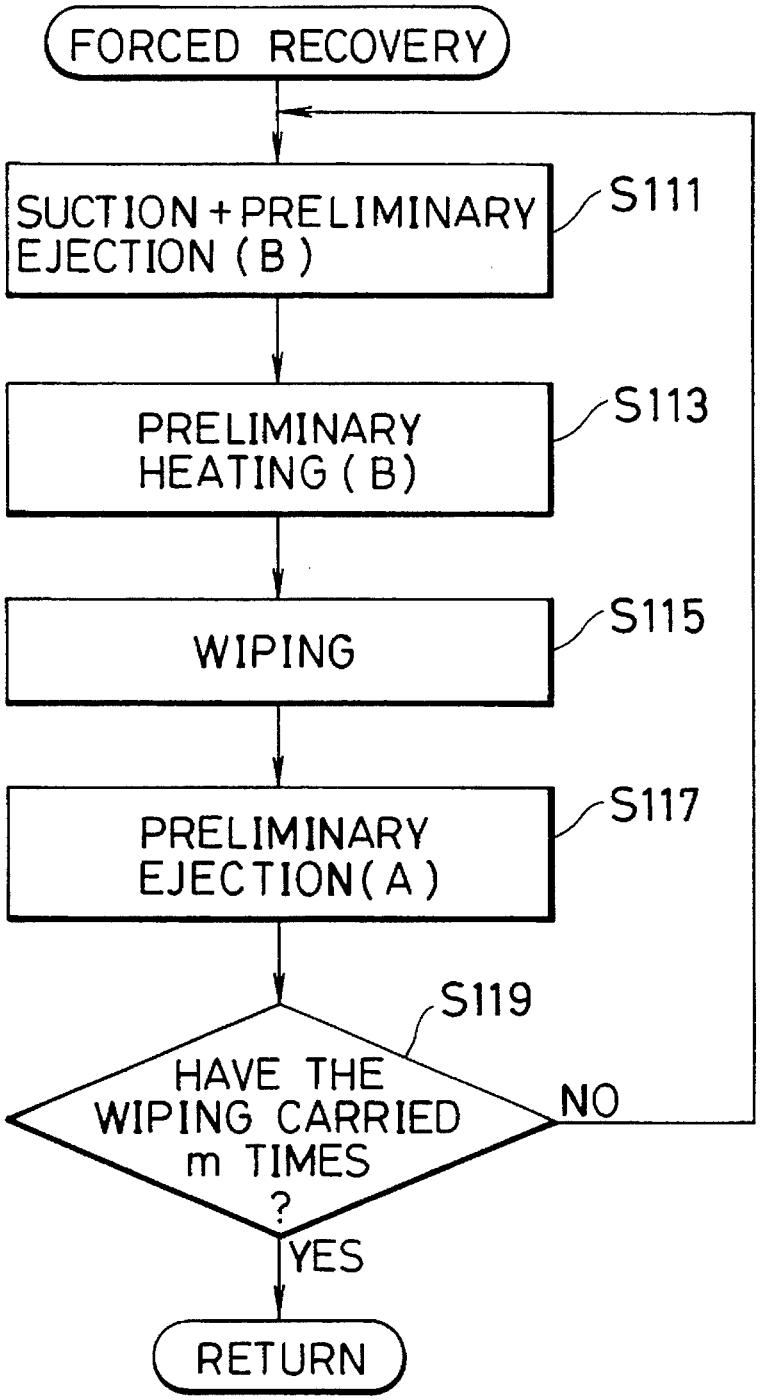
FIG. 11 is a flow chart showing an example of the forced restoration procedure in the procedures shown in FIGS. 7A and 7B.

Referring again to FIG. 8, in step S51, in case that 72 hours or more have passed since the latest restoration procedure by sucking operation was performed when the power switch is turned on or before the recording operation is started, the ejection restoration mode using timer suction is performed in step 73. In this case, prior to the ejection restoration mode using timer suction, the preliminary heating (B) mode and wiping operation are performed in step S71 in order to make it easier to remove the viscous ink fluid. As this is also an effective way as the supplementary means for the suction restoration operation in order to reduce the amount of the ink fluid to be discharged by suction, this heating operation may be performed in the counter recovery operation as shown in FIG. 11 and the forced recovery operation shown in FIG. 12. So far, in this embodiment, as adhesive substances such as the viscous ink fluids can be removed efficiently, the ejection performance of the recording head can be maintained to be in a good condition for a long period of time.

In FIG. 8, after step S73, the 72-Hr timer and the 4-Hr timer are reset in steps S75 and S77, respectively, and the wiping operation in step S79 is performed before going back to the main routine shown in FIG. 7.

Another preliminary heating may be also performed before the wiping operation in step S79, and after the wiping operation in step S79, the preliminary operations similar to those in steps S65 and S67 may be added.

FIG. 9 shows an example of procedures of the wiping and capping operations in step S7 shown in FIG. 7. A timer for reporting a designated time passed, for example, 0.5 Hr, since the cap was on, which is designated as 0.5-Hr timer, is initialized in step S81 at first, and after the wiping operation is performed in step S83, and finally the capping operation is performed in step S85 before going back to the main routine.

FIG. 10A shows an example of procedures of the standby operation for waiting for the request to start the recording operation. At first, in step S91, checked is whether the cap is on or not. If the cap is on, then, in step S93, whether 72 hours have passed or not since the cap was on is judged. If step S93 reports an affirmative conclusion, the main routine is called back and followed by the suction restoration operation is performed by the ejection restoration mode using timer suction before the recording operation. If step S93 derives a negative conclusion, step S95 is reached where judged is whether 0.5 Hr has passed or not since the cap was on. If step S95 reports a negative conclusion, the main routine is called back. If step S95 reports an affirmative conclusion, the preliminary ejection (C) mode is performed after the preliminary heating (B) mode operation in steps S97 and S99. After that, 0.5-Hr timer is reset in step S101 before going back to the main routine.

In case that step S91 concludes that the cap is off, that is, open, whether a designated time, for example, 5 seconds, has passed or not since leaving the cap kept open is judged in step S103. If step S103 reports an affirmative conclusion, in step S105, the wiping and capping operations described with FIG. 9 are performed before going back to the main routine.

FIG. 10B is another embodiment of the standby routine shown in FIG. 10A of the present invention. In FIG. 10B, step S98 for the idle ejection operation of the ink fluid into the cap is performed instead of the preliminary ejection (B) and (C) modes in steps S97 and S99 in FIG. 10A. This idle ejection operation of the ink fluid into the cap unit 300 is performed while the connection pipe part of the pump unit 500 to the cap unit 300 is opened to the atmospheric air. By means of the idle ejection operation into the cap inside of which communicates to the atmospheric air, the inside of the cap can be maintained to be moisten enough and the pressure variations in the cap can be reduced so as to prevent the meniscus of the ink fluid in the ink passage from deviating from a right position.

FIG. 11 shows an example of forced restoration procedures invoked by turning on the recovery switch 826.

At first, in step Sill, the preliminary ejection (B) mode while sucking the ink fluid is performed, and next, after the preliminary heating (B) mode in step S113, the wiping operation in step S115 and the preliminary ejection (A) mode in step S117 are performed. It is allowed that the repetition of these operations is controlled by step S119.

As described earlier, prior to step S111, for example, the preliminary heating (B) mode and the wiping operation may be performed. In addition, prior to step S117, the preliminary heating (A) mode may be performed.

FIG. 12 shows an example of procedures of the counter recovery operations.

At first, in step S121, judged is whether a designated number of recording media, for example, 10 sheets, have been recorded or not since the previous suction restoration operation was performed. If step S121 reports an affirmative conclusion, the suction restoration operation by the ejection restoration mode using counter which is described before is performed in step S123, before which the preliminary heating and wiping operations may be performed, and timers are reset in step S125.

After step S125 or in case that step 121 derives a negative conclusion, step S127 is performed for the preliminary heating (B) mode, and the wiping operation in step S129 and the preliminary ejection (A) mode in step S131 are followed before going back to the main routine.

In the above described procedures of FIGS. 6– 12, the heating to the recording head is performed prior to the restoration operations. However, it may be allowed that the heating to the recording head is so performed not to produce an adverse effect on the restoration operations while the restoration operations are performed.

In addition, in the above description, the modes and their operational conditions and setup parameters of the timers are one set of examples, and hence these parameters and conditions may be selected to be adequate values according to demand.

Exemplary Verification of Effect

The durability and stability of quality of the recorded images are verified with respect to the above mentioned ink jet recording apparatus of first embodiment of the present invention. The following numerical parameters and conditions are used for estimating this embodiment.

| | | |
|---|---|---|
| Blade: | Thickness | 0.7 mm ± 0.1 |
| | Width | 12.0 mm ± 0.1 |
| | Free Length | 8.0 mm ± 0.1 |

Extended Length of the Blade in wiping the recording head in relative to the orifice-disposed face: 1.5 mm ± 0.5
Extended Length of the Blade in cleaning the blade in relative to the cleaner edge part: 4.0 mm ± 0.5
Carriage Moving Speed: 200 mm/sec ± 30 (in wiping)
100 mm/sec ± 30 (in cleaning)
Recording Head: 400 dpi(dot per inch), 128 orifices/head
Wiping Operation Occurrence: 1 time per recording a single A4-sized sheet
Timer Recovery Operation Occurrence: 1 time every 74 hours
Counter Recovery Operation Occurrence: 1 time per recording 10 sheets
Viscous Ink Fluid Removing Operation Occurrence: 1 time every 4 hours
Temperature of the recording head in the recording operation: 38° C.
Temperature of the recording head in the preliminary heating (A) mode: between 35° C. and 40° C.
Temperature of the recording head in the preliminary heating (B) mode: more than 50° C.
Atmospheric Parameters: 35° C. (Hot Temperature) and 10% (Low Humidity)

The test was performed in such a severe condition that the amount of the ejected ink fluid and the amount of the ink fluid adhesive to the orifice-disposed face is large, and the atmospheric temperature is high and the humidity is so low that the evaporation of the ink fluid is highly activated. In the recording operation where the ink fluid is ejected fully and continuously during the recording operation per a single scanning line on the recording medium, that is, fully painted, and 5000 A4-sized sheets are recorded in 10 days (500 sheets/day) with 12 hours interval during which the recording operation stops, there was not found any ink ejection ink failure such as discontinuous and nonuniform ejection operations. However, in case of skipping the preliminary heating (B) mode, at the start of the recording operation after stopping the recording operation for 12 hours, there was a case that some discharge ink failure was found, which demonstrates the effect by the present invention.

Modification Example of the Wiping Direction and the Timer Control of the Preliminary Heating Operation In this embodiment, the direction of the movement of the blade 401 in the wiping operation is vertical to the direction along which the orifices are arranged. In a modification of this embodiment, in the wiping operation, the blade 401 may be moved in the direction along which the orifices are arranged on the orifice-disposed face.

The ink passages called dummy nozzles from which the ink fluid is not ejected in the recording operation are placed in the both end sides of the segmented line defined by the orifices arranged in an array. This configuration is for reducing the space dependency of the ink fluid dynamics in the ejection operation such as vibration of the ink fluid.

Dummy nozzles also bring other effects in wiping the orifices in the direction along which the orifices are arranged. If the viscous ink fluid is adhesive onto the orifice-disposed face, the viscous ink fluids may go back into the orifices again in the wiping operation in the above described embodiment of the present invention. In this modification, only the ink fluid between adjacent orifices may go back into the orifices, and even in the orifices in the both end sides of the segmented line defined by the orifices arranged, the viscous ink fluids and unfavorable] adhesive substances can be caught by the dummy nozzles, and hence, the ejection operation is less subject to the move viscous ink fluids on the orifice-disposed face in this modification that the original embodiment described above. However, even in this modification, as the ink fluid is only replaced every time the suction restoration operation is performed, the ink fluid in the dummy nozzles may be tend to be getting more viscous than the ink fluid in the other orifice, and hence, the viscous ink fluids may be dried out, solidified and piled up on the orifice.

In this modification, considering increase in the viscosity of the ink fluid, the timer II (the 4-Hr timer in the generic embodiment judging whether the preliminary heating and wiping operations are required or not and the timer I (the 72-Hr timer in the generic embodiment) are made to be correlated. That is, the duration period of time defined by the timer II can be varied to be gradually reduced in responsive to the period of time having passe since the suction restoration operation was performed. For example, the duration period of time defined by the timer II may be selected 4×72/(72-T1), where T1 is the counted period of time by the timer I.

Modification Example of the Control of the Temperature in the Preliminary Heating Operation In the generic embodiment described above, the temperature in the preliminary heating operation performed before the wiping operation is kept constant. The temperature in the preliminary heating operation may be varied in correlation between the period of time during which the recording operation has been stopped and the viscosity of the ink fluids. In this modification, in the preliminary heating operation, thermal energy is applied to the ink fluid in ink passage for a designated period of time by the electro-thermal conversion elements used for ejection operation so that the ink fluid may not be boiled and that the ink fluid may not be ejected. That is, the preliminary heating operation is performed by giving a designated repetitive number of pulses with its pulse width less than the width used in an ordinary ejection or recording operation. In determining the number of pulses to be supplied to the electrothermal conversion element, referred is a reference table in which the number of pulses for the preliminary heating (A) operation and the number of pulses for the preliminary heating (B) operation are defined in a positive correlation with the minimum number of puses for (A) and (B) set to be identical to each other.

Similarly to varying the number of pulses in the preliminary heating operation, various kinds of parameters including the duration period of the preliminary heating (B) operation, the number of the repetitive wiping action in a single wiping operation, the preliminary ejection condition after the wiping operation and the combination of the suction restoration operation and other restoration operations can be selected as effective alternatives for removing the viscous ink fluids after a designated period of time since the recording operation was terminated. The selection of these alternatives is based on the environmental temperature, the amount of the ink fluids stored in the ink tank which may affect the static ink fluid pressure developed at the orifice, the occurrence of the recording operations before the recording operation was temporarily terminated which affects the amount of the ink fluids adhesive onto the orifice-disposed face of the recording head.

SECOND EMBODIMENT

This embodiment relates to the structure for performing the idle ejection into the cap inside of which is being communicated to the atmospheric air.

Figure 13:
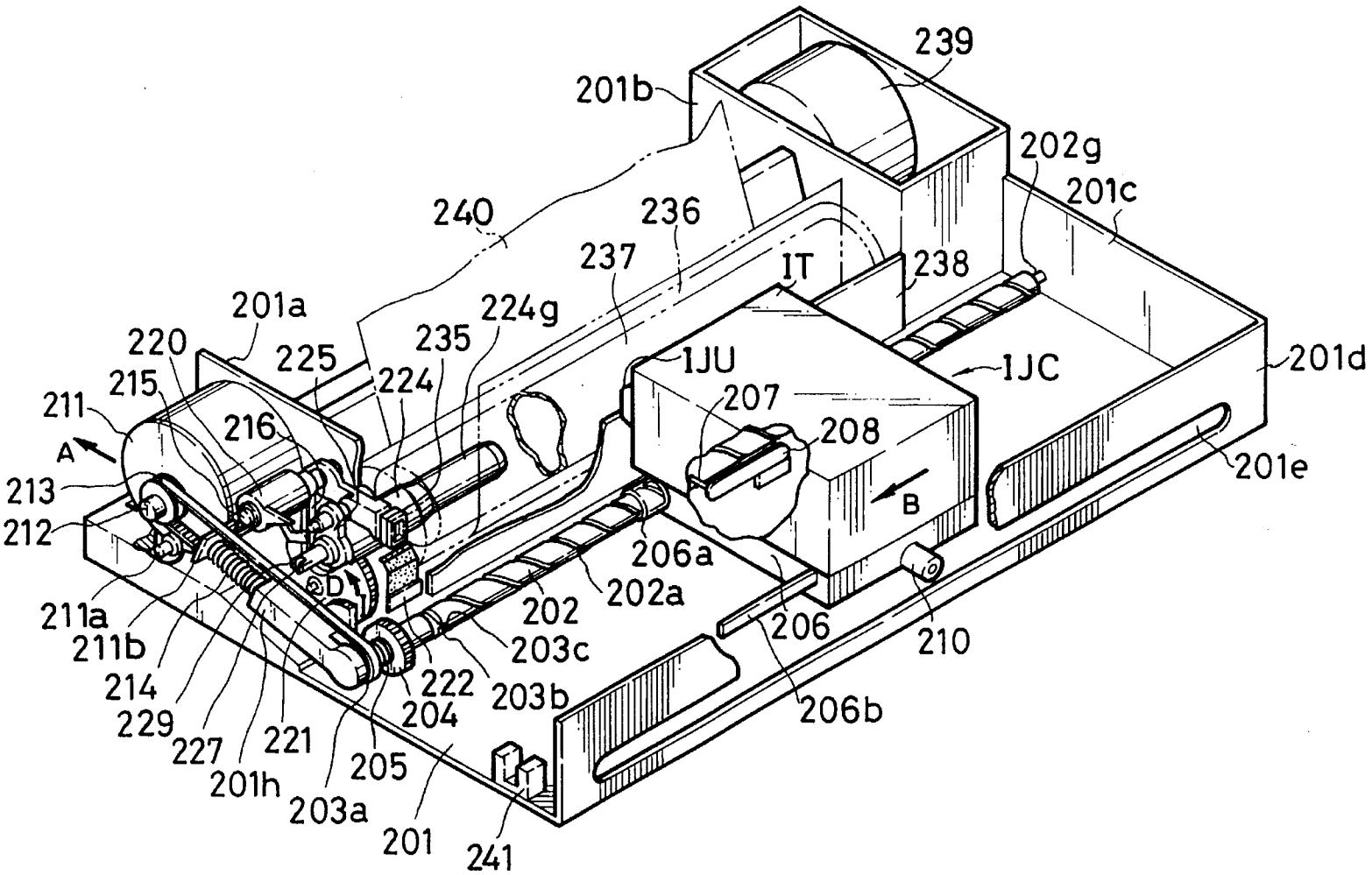
FIG. 13 is a perspective view of an ink jet recording apparatus of a second embodiment of the present invention.

FIG. 13 is an overall perspective view of an ink jet recording apparatus of second embodiment of the present invention.

In FIG. 13, component 201 is a chassis, on which the left side panel 201*a* and the right side panel 201*b* used also as guides for a recording medium like paper sheet are fixed. A front side panel 201*c* is placed on the right end part of the chassis 201, and a carrier guide plate 201*d* is placed on the front end part of the chassis 201. Component 201*e* is a long hole for guiding the carrier formed on the guide plate 201*d*, and the carrier guide roller to be described later is coupled with the long hole 201*e* so as to move freely in the width direction. In addition, a motor mount hole, not shown in FIG. 13, for supporting the carrier motor to be described later so that the carrier motor may move and rotate is formed on the chassis 201.

The lead arm 201*h* formed in an apparatus fixing part is used for supporting a lead screw to be described later in its axial and radius directions, and its support point is defined on the bearings of the lead arm 201*h*.

Component 202 is a lead screw on the surface of which a lead groove 202*a* is formed with a designated pitch in corresponding to the recording width of the recording head on the recording medium. At the carrier home position side of the lead screw 202, a capping groove 203*b* used for defining a capping position and a restoration position is formed to be a circle around the cross-section vertical to the axis of the lead screw 202, and the capping groove 203*b* and the lead groove 202*a* are continuously linked by the coupling groove 203*c*.

At the both ends of the lead screw 202, shafts 202*g* are formed and coupled with the bearings formed on the front side panel 201*c* and the lead arm 201*b* so as to rotate freely. A pulley 203*a* is installed in adjacent to the end part of the lead screw 202 supported by the lead arm 201*h*. The pulley 203*a* is driven by the motor 211 through the timing belt 213. The right side shaft 202*g* of the lead screw 202 is pressed by a plate spring not shown in FIG. 13 in its axial direction.

And furthermore, a clutch gear 204 is installed adjacent to a portion of the lead screw 202 where the pulley 203*a* is fixed. The clutch gear 204 is supported by the lead screw 202 so as to move freely in the axial direction of the lead screw and is coupled with a stopper not shown in FIG. 13 so that a rotational force developed by the lead screw 202 may be transmitted to the lead screw 202. A component 205 is a clutch spring which is formed as a compressive spring so that the clutch gear 204 may be pressed toward the lead groove 202*a*. A restriction member is formed between the clutch gear 204 and the lead screw 202 in order to restrict the displacement of the clutch gear 204 within a designated region. The restriction member is not shown in FIG. 13.

Component 206 is a carrier installed on the lead screw 202 so as to move along the lead screw 202. Component 206*a* is a pressing member formed together on the left side of the carrier 206 for pressing the side face of the clutch gear 204 in responsive to the displacement of the carrier 206. Component 206*b* is a sensing bar formed at the carrier 206, the position of which is detected by the sensor to be described later in relative to the displacement of the carrier 206 in order to detect that the carrier 206 is located in the home position. Component 207 is a lead pin installed in the carrier 206 and linked to the lead groove 202*a* on the lead screw 202. Owing to the lead pin 207, when the lead screw 202 is rotating, the lead pin 207 receives a force developed by the lead groove 202*a* in the axial direction of the lead screw 202 and hence, the carrier 206 can be moved. Component 208 is a lead pin spring with its one end fixed on the carrier 206, which presses the lead pin 207 toward the lead groove 202*a* in order to establish an effective coupling between the lead pin 207 and the lead groove 202*a*.

Component IJC is a recording head cartridge removable from the carrier 206. In this embodiment the recording head cartridge IJC is formed as a single cartridge unit including a recording head unit IJU for ejecting ink fluid and an ink tank IT as an ink fluid source. Owing to this structure, the recording head unit IJU and the ink tank IT can be replaced together when the ink tank IT is empty. As for energy generating elements arranged in the recording head unit IJU and used for developing energy for ejecting ink fluid to the ink fluids, an electro-thermal conversion element or an electromechanical conversion element can be used. In the recording head unit of this embodiment, the former element is used because the former element enables the high density installation of ink fluid orifices and easier assembly processes.

Component 210 is a carrier roller installed on the back end face of the carrier 206 so as to rotate freely and be linked with the long hole 201*e* on the carrier guide plate 201*d* of the chassis 201.

Component 211 is a carrier motor such as a pulse motor. On the front face and the back face of the carrier motor 211, the rotating pins 211*a* are installed in an eccentric position below the shaft of the carrier motor 211, and these pins 211*a* are coupled with motor mount holes formed on the chassis 201 so as to rotate freely. Hence, the carrier motor 211 can be rotated on the axis of the rotating pins 211*a*. Component 211*b* is a spring catcher formed together with the carrier motor 211, and is installed so as to be parallel to the axis of the shaft of the carrier motor 211 in order to fix the end of the motor spring 214 to be described later. A cylindrical protruding part is formed on the spring catcher 211*b* in order to fix the end of the motor spring 214.

Component 212 is a motor pulley fixed on the shaft of the carrier motor 211. Component 213 is a timing belt extended between the motor pulley 212 and the pulley 203*a* fixed on the shaft of the lead screw 202. The motor spring 214 of this embodiment is a compressive coil spring installed between one end of the lead arm 201*h* and the spring catcher 211*b* of the carrier motor 211. By means of this structure, the timing belt 213 can be expanded by the rotational replacement of the carrier motor 211 on the rotating pins 211*a* in the direction shown by an arrow A in FIG. 13.

A set shaft 215 is installed on the left side plate 201*a*, and a blade for cleaning the orifice-disposed face of the recording head unit, a cap and other mechanism for ejection restoration operations are installed around the set shaft 215.

The boss part of the blade lever 216 for moving the blade for wiping the orifice-disposed face in relative to the recording head is installed on the set shaft 215 so as to rotate freely.

In addition, a set lever 220 is installed on the set shaft 215 so as to rotate freely, and the set lever 220 rotates in responsive to the rotational movement of the lead screw 202 coupled with the clutch gear 204 driven by the carrier motor 211. As the lead screw 202 rotates, the hook formed on the top part of the set lever 220 is linked with a shaft not shown in FIG. 13 of the blade lever 216 and a protruding part of the set lever 220 is linked with a long hole not shown in FIG. 13 formed on the blade lever 216. By means of this structure, the blade lever 216 rotates with delay in responsive to the rotational movement of the set lever 220, and hence, the wiping action of the blade 217 not shown in FIG. 13 is established so that the orifice-disposed face of the recording head unit IJU may be cleaned.

In the opposite position to the home position of the recording head unit IJU of the recording apparatus, the cap 235 is placed. The cap 235 can also moves forward and backward in relative to the orifice-disposed face of the recording head unit IJU in responsive to the rotational movement of the lead screw 202 developed by the transmitted force through the clutch gear 204. In the following, a restoration system unit having the cap 235 is described by referring to FIGS. 14A and 14B and FIG. 15.

Component 224 is a cylinder composed of a hollow cylinder part 224*a* and a guide part 224*b* for guiding the piston shaft to be described later. In the guide part 224*b*, an ink route is formed by removing a part of the cylindrical member in its axial direction. Component 224*d* is a cap lever catcher so formed that a lever seal to be described later may be caught by the cap lever catcher. Component 224*e* is an ink route connected to an open port to a designated position inside the cylinder part 224*a*. Component 224*f* is a rotating lever formed together with the cylinder 224 and is given a rotational force by the cap spring 243 not shown in FIG. 14A. Component 224*g* is a waste ink pipe formed together with the cylinder 224 and its top part is so shaped that the waste ink pipe itself may be easily inserted to the waste ink absorber 237 to be described later. Component 224*h* is an ink route formed inside the waste ink tube 224*g*.

Component 225 is a cylinder cap pressed against the end part of the cylinder 224. Component 225*a* is a lever guide placed in the opposite position to the above mentioned cap lever catcher 224*d* of the cylinder 224.

Component 226 is a piston seal inserted in the cylinder 224 and its inner diameter is taken to be a little smaller than the diameter of the piston shaft so as to establish a designated pressing force applied to the piston shaft. It is allowed that the friction between the piston seal and the piston shaft may be reduced by coating lubricating fluid on the surface of the piston seal.

Component 227 is a piston shaft around which an acting shaft 227*a*, a piston supporter 227*b*, a piston catcher 227*c*, a connecting shaft 227*d* and a guide shaft 227*e*, and additionally, a groove 227*f* to be used as an ink route is formed along the connecting shaft 227*d* and the guide shaft 227*e*. Component 227*f* is a rotating stopper defined as a groove formed on the acting shaft 227*a*. The piston supporter 227*b* is formed at the end face of the acting shaft 227*a*.

Figures 14A, 14B:
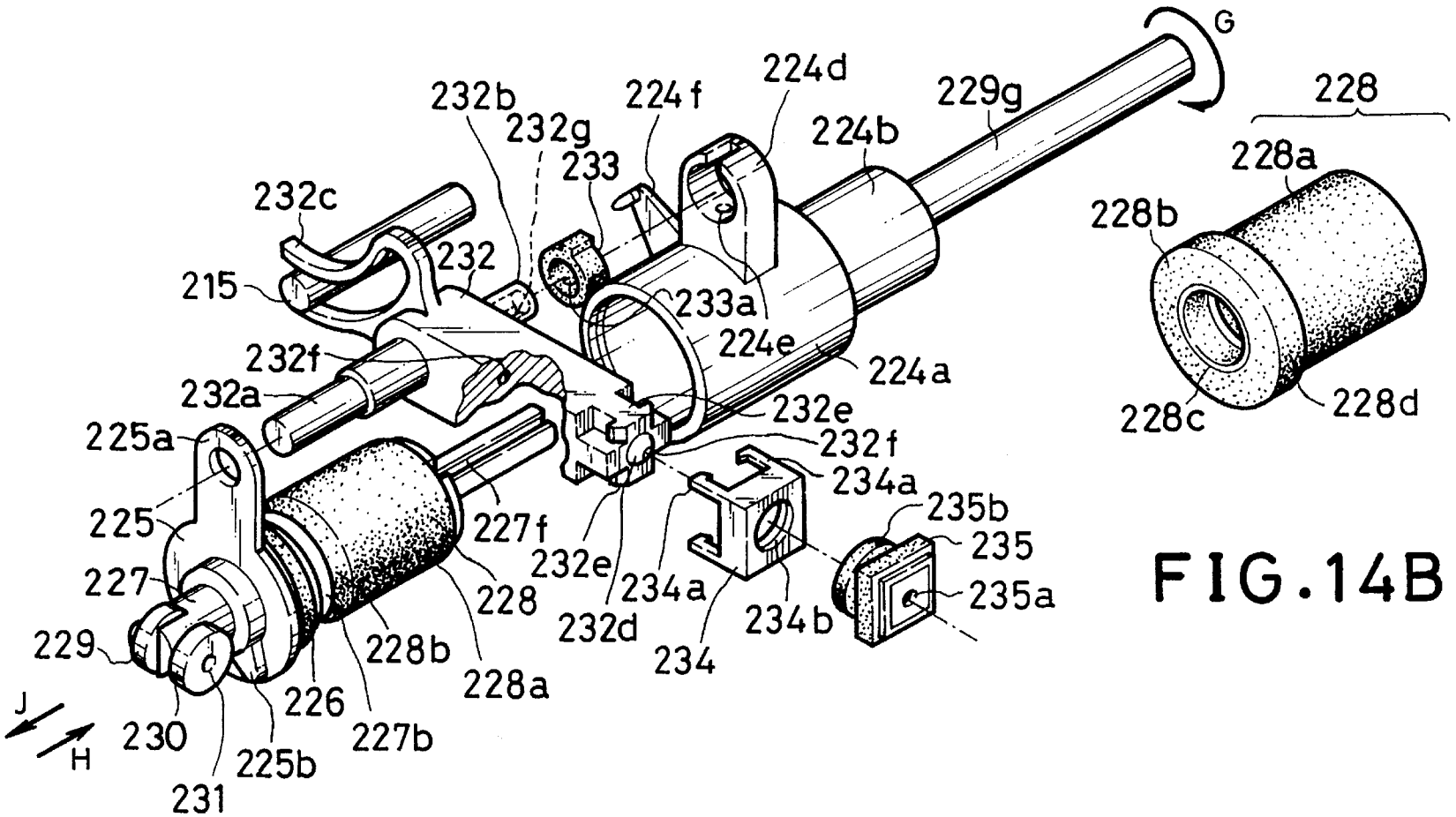
FIG. 14A is a perspective view of decomposed components of a suction pump shown in FIG. 13
FIG. 14B is a perspective view of a piston of the suction pump shown in FIG. 13.

Component 228 is a piston made of rubber materials such as NBR, and its detail structure is shown in FIG. 14B.

In FIG. 14B, component 228*c* is a seal rib shaped in a ring with its axis being equivalent to the axis of the end face part 228*b* of the piston 228 and with its end face being on the same face defined by the end face part 228*b*. The seal rib 228*c* contacts directly to the piston supporter 227*b* when the piston 228 moves and links with the piston supporter 227*b*, and the firm contact between the seal rib 228*c* and the piston supporter 227*b* can be established by forming a contacting part to be a circle line, and when the piston 228 moves back from the piston supporter 227*b*, the viscous ink fluid does not affect its dissociation movement. The piston 228 can be made of ink absorbing materials such as urethan foam containing air voids. In this case of using urethan foam having an ability to keep humidity, it is appreciated that the friction property between the cylinder 224 and the piston 228 does not change even if the piston is deformed due to less humidity after a period during which the pump has not been operated.

Referring again to FIGS. 14A and 14B, and FIG. 15, component 242 is a pump chamber where suction pressure is developed in responsive to the displacement of the piston 228. Component 229 is a piston pressing roller installed at the end part of the piston shaft 227 so as to rotate freely. Component 230 is a piston recovery roller also installed at the end part of the piston shaft 227 so as to rotate freely. Component 231 is a common shaft to these rollers 229 and 230. The piston pressing roller 229 and the piston recovery roller 230 are linked with a cam not shown in FIG. 14A and this cam is driven by the rotational movement of the lead screw 202 transmitted by the clutch gear 204 and so on. By means of this structure, the piston 228 can moves back and forth inside the cylinder 224 in order to establish ink fluid suction operations.

Component 232 is a cap lever around which a rotating shaft 232*a*, an ink guide 232*b* and a lever guide 232*c* are formed together. And a convex and spherical-shaped seal face 232*d* is formed on the top part of the cap lever 232. A couple of coupling parts 232*e* are formed at the top part of the cap lever 232, with which latches of the cap holder to be described later are coupled. And furthermore, an ink route 232*f* penetrates through the cap lever 232 from the seal face 232*d*, bends on the center of the ink guide 232*b* at right angles and finally reaches the open port formed on the ink guide 232*b* along the center axis of the ink guide 232*b*. A cutout portion 232*g* is formed on the bottom side of the ink guide 232*b*.

Component 233 is a lever seal into which the ink guide 232*b* is inserted and which is inserted into the cap lever catcher 224*d*. Component 233*a* is an air duct hole between the cutout portion 232*g* of the ink guide 232*b* and the ink route 224*e*.

Component 234 is a cap holder, and two pairs of hooks 234*a* to be coupled with the coupling part 232*e* of the cap lever 232 are formed on the corners of the cap holder 234. Component 234*b* is an open port where a cap to be described later is installed.

Component 235 is a cap to be installed into the open port 234*b* of the cap holder 234. The cap 234 is used for covering the orifice-disposed face of the recording head unit IJU, preventing the ink fluid from being evaporated and applying suction pressure inside the cap in order to suck the ink fluid. A suction port 235*a* is formed on the cap 235, and the ink route established through the cap 235 goes from the suction port 235*a* to the open port on the opposite side while winding between these ports. This open port on the opposite side of the cap 235 is connected to the open port formed on the seal face 232*d* and further linked to the ink ink passage 232*f* in the cap holder 234.

Component 235*b* is a flange part formed in a part of the cap 235 used for fixing the cap 235 in the cap holder 234. A cap seal part 235*c* not shown in FIG. 14B is formed on the flange part 235*b*, the shape of which has a concave sphere with its curvature equivalent to the curvature of the seal face 232*d* of the cap lever 232. When the cap 235 is installed in the cap holder 234, the cap 235 is pressed to the cap lever 232 and the connection between the open ports of the cap 235 and the cap lever 232 is established so as to form the overall ink route. In this structure, as the shape of the seal parts 232*d* and 235*c* is a sphere, the equalizing capability of these cap members is highly established even if there is any eccentric displacement between the cap 235 and the cap lever 232, and hence, a stable sealing condition can be obtained by correcting the nonuniform and discontinuous displacement on the orifice-disposed face.

Figure 15:
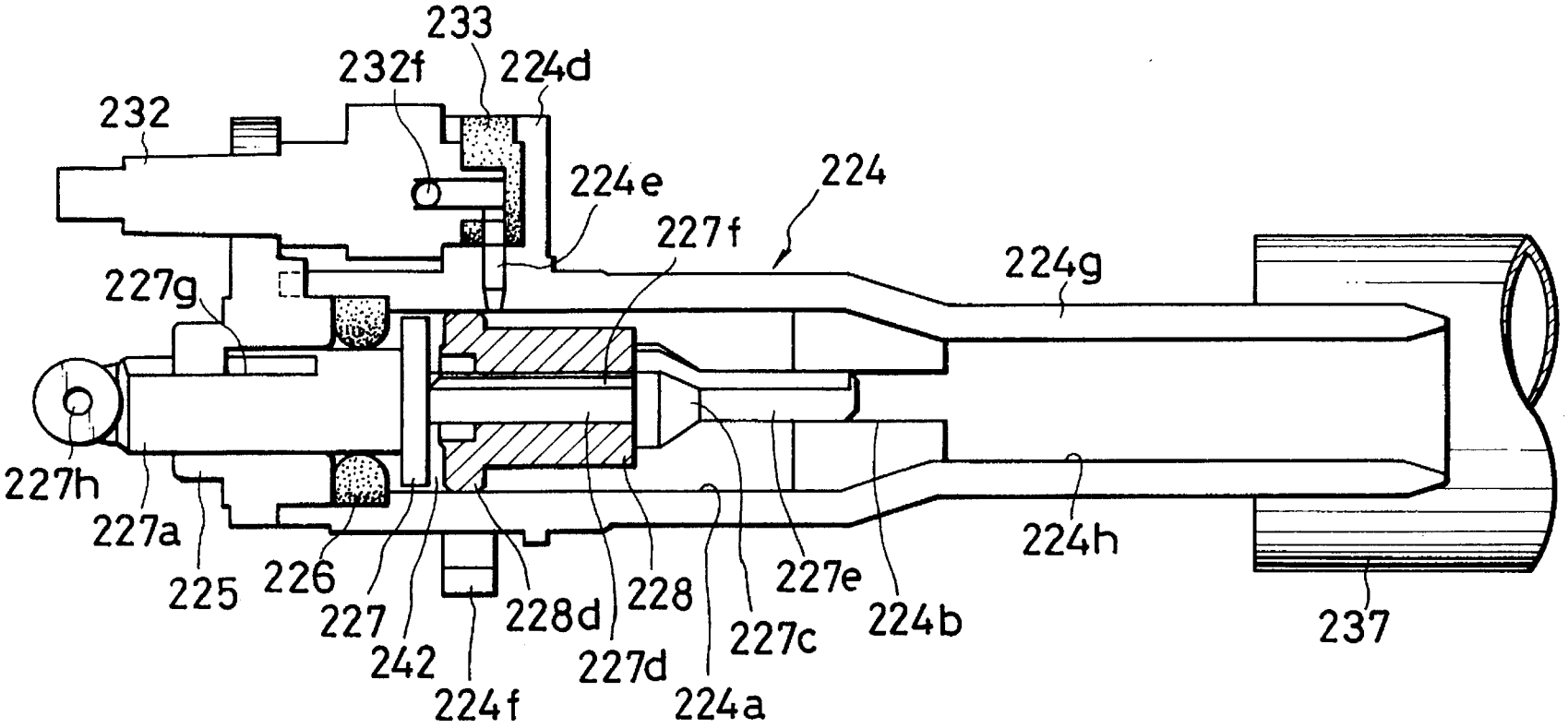
FIG. 15 is a cross-sectional view of the suction pump shown in FIG. 13.

FIG. 15 shows a case that the piston 228 is located in an upper dead center. In capping operations for the orifice-disposed face of the recording head unit IJU, the piston 228 is located in an upper dead center. In this state, as the ink route 224*e* formed in the cylinder 224 is not closed by the rib 228*d* of the piston 228 and the end part of the waste ink pipe 224*g* opens to the atmospheric air through the absorber 237 containing air voids, the inside of the cap 235 is in an intermediately open state to the atmospheric air through the ink route 232*f* as shown in FIGS. 14A, 14B and 15. As a result, there is not such a problem in capping the recording head as recognized conventionally to be one of problems like ink fluid leakage due to pressure variation in the cap.

Referring again to FIG. 13, component 236 is a paper feed roller for supplying recording medium such as paper sheet, which is formed by, for example, coating an aluminum tube with elastic materials such as urethan foam. Not only the roller 236 is used as a platen for regulating the recorded surface of recording medium on its surface, but also the inside of the roller 236 is used as a storage of the waste ink fluid. Component 237 is a waste ink fluid absorber installed in the roller 236, which is composed of a plurality of thin tubes made of plastic materials such as polyethylene and EVA, each tube filled with absorbing materials such as polyester textiles so that the whole body of the waste ink fluid absorber 237. It is preferable that texture materials used for the waste ink fluid absorber 237 are such non-absorptive materials as synthetic resin and metals.

Component 238 is a paper press plate installed on the chassis 201. Component 239 is a paper feed motor linked to the paper feed roller 236 via slowing down gears having a designated slowing-down ratio.

Component 240 is a recording medium such as paper sheet and transparent film.

Component 241 is a detector for detecting the home position of the carrier, which is composed of a photo interrupter using optical signal processing in this embodiment. In the detector 241, whether the carrier is located in the home position or not can be judged by the sensing member of the carrier 206 cutting the optical beam to the optical detector.

Figure 16:
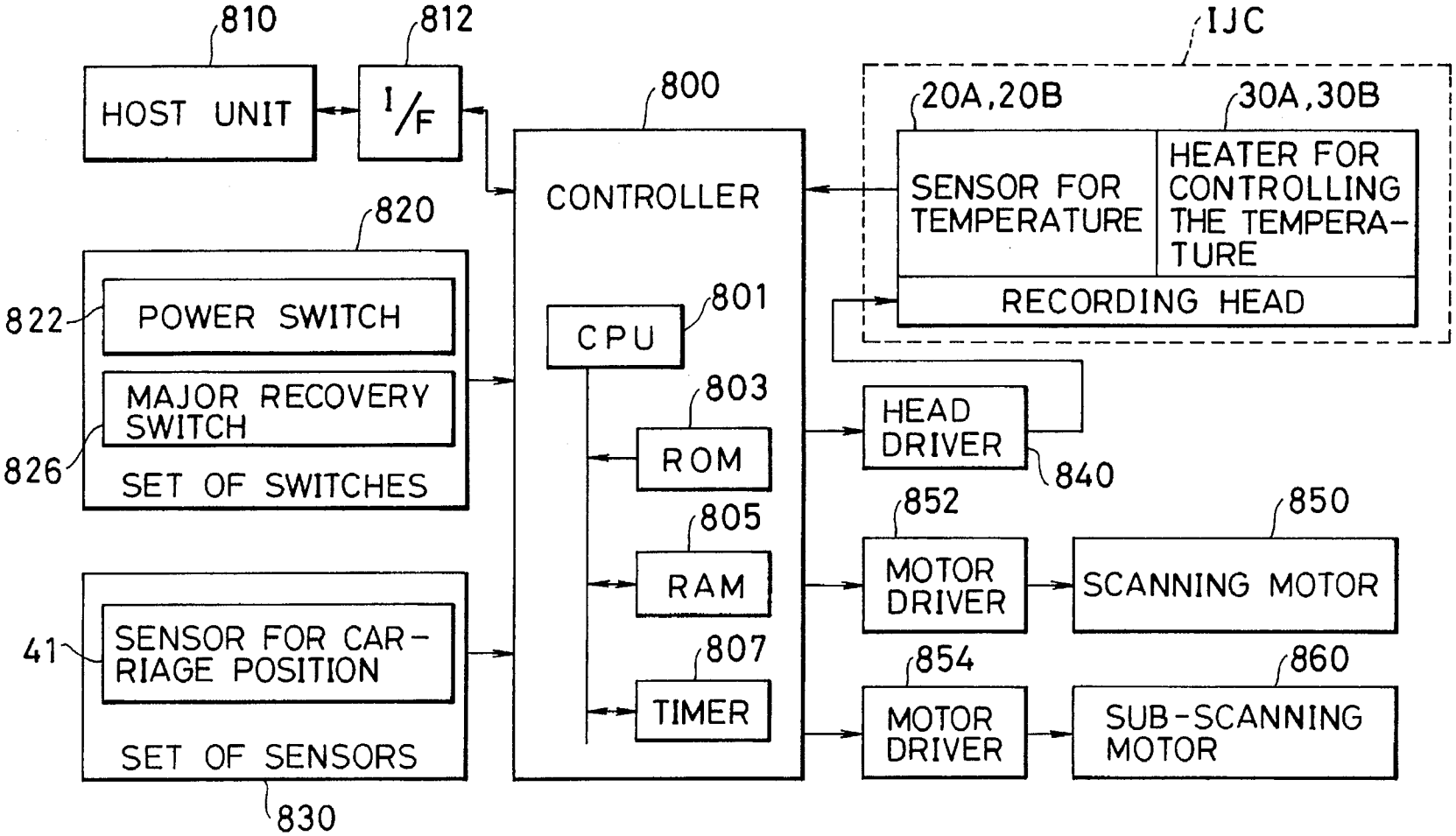
FIG. 16 is a block diagram showing the control logic of the ink jet recording apparatus shown in FIG. 13.

FIG. 16 is a block diagram showing an example of procedural structure of the control system in the ink jet recording apparatus shown in FIG. 13.

Figure 17A:
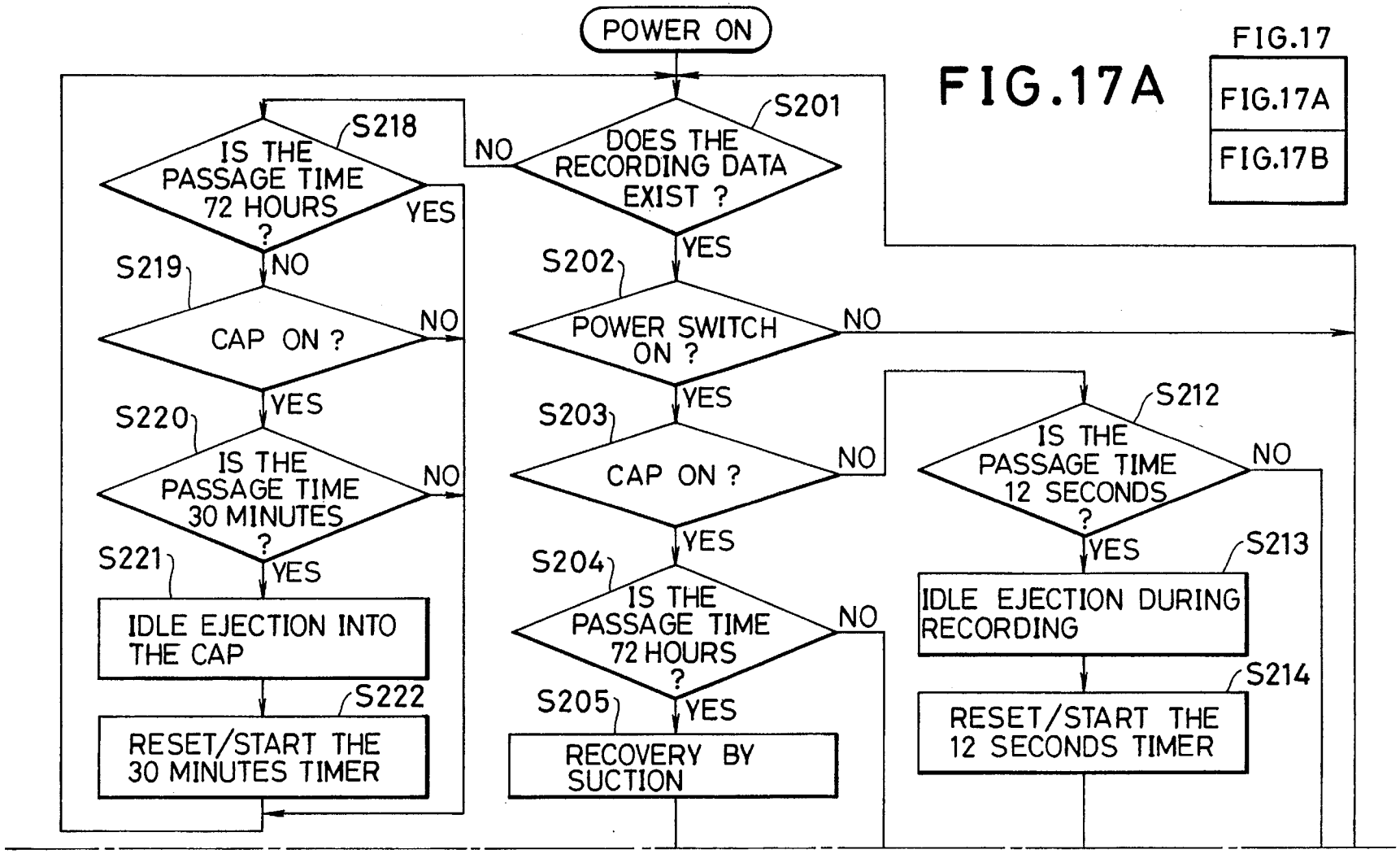
FIG. 17 represents the composite of FIGS. 17A and 17B which are flow charts of the procedures in the ink jet recording apparatus shown in FIG. 13 in applying the present invention.
Figure 17B:
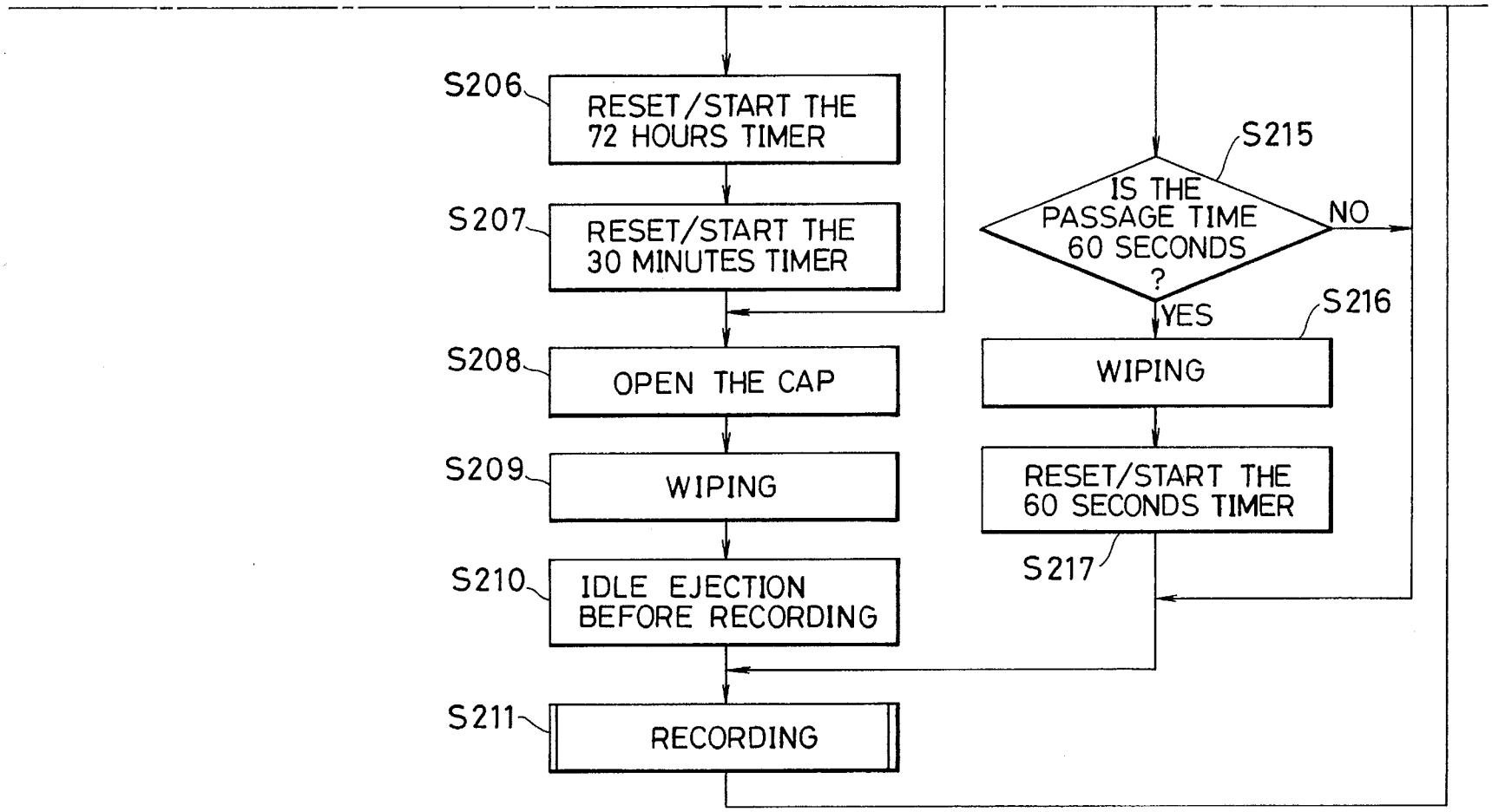

Component 800 is a controller forming a major control part having CPU 801 such as a microcomputer executing procedures to be described in FIGS. 17A and 17B, ROM 803 storing programs capturing the procedures, a table, data on voltages of the driving signal, pulse width and other fixed data used for moderating driving signals for driving electrothermal conversion element of the recording head unit, and RAM 805 comprising a region for storing image data and a region for storing working data temporarily. In addition, the controller 800 has a timer for counting predefined period of times to be described with FIGS. 17A and 17B. Component 810 is a host system as an image data supplier which exchange image data, control commands and status signals through the interface (I/F) 812 between the controller 800.

Component 820 is a set of switches accepting command inputs and requests from the operator, which includes a power switch 822 for turning on and off the recording operations realized by software in the ink jet recording apparatus and an overall restoration operation switch 826 for requesting the start of the overall restoration operation as one of recording and ejection restoration procedures. Component 830 is a set of sensors for detecting the apparatus status which includes sensors detecting the home position and the start position of the carriage 206 and so on.

Component 840 is a head driver for driving the electrothermal conversion element of the recording head unit in responsive to the recording data. A part element of the recording head unit in responsive to the recording data. A part of the head driver is used for driving the temperature control heater 30A and 30B. In addition, the temperature detecting signals from the temperature sensors 20A and 20B are supplied into the controller 800. Component 850 is a main scanning motor for moving the carriage 282 in the direction along which the platen is extended, and component 852 is a driver for the main scanning motor 850. Component 860 is a sub scanning motor used for transporting the recording medium.

FIGS. 17A and 17B are flow charts showing procedures executed accompanied by the request to switch on the above described ink jet recording apparatus.

In the recording apparatus of this embodiment, the CUP 801 of the controller 800 shown in FIG. 16 is ready to be operated if the power line to the apparatus is plugged to the power outlet. In this state of the recording apparatus, information display indicators of the recording apparatus of this embodiment are not activated and the recording apparatus does not accept the request command for starting the recording operation and recording data, but the CPU 801 of the recording apparatus is activated to execute the procedures to be described below.

In step S201, checked is whether the recording data transmitted from the host system 810 is stored or nor in the RAM shown in FIG. 8. If the recording data arrives at the recording apparatus, whether the power switch 822 shown in FIG. 16 is turned on or not in step S202. If the power switch 822 is turned on, the recording operation starts and the transmission and exchange of signals between the host system can be allowed. In addition, the above described information display indicators of the recording apparatus of this embodiment is activated. So far, if the power switch 822 is turned off, the recording operation is not performed , and if the switch 822 is turned on, the recording operation is performed and the capping operation is checked in step S203.

If step S203 concludes that the cap is on and the recording operation is ready to be performed, in step S204 checked is whether the recording head has not been used for the ejection operation for a designated long period of time. In this embodiment, if the recording head has been unused for more than 72 hours, step S204 concludes that the recording head has not been used. If this is the case, step S205 is next selected for performing the suction operation by activating the piston 228 shown in FIGS. 14A and 14B and FIG. 15. Next in step S206, the timer for counting 72 hours, which is designated 72-Hr timer, is reset for restart. Next, in step S207, the 30-Min timer for judging the idle ejection operation into the cap is reset for restart. This is because the recording head is initialized when the suction operation is performed. If step S204 concludes that the recording head has not been used for more than 72 hours, then step S208 is directly selected after step S204.

In step S208, the cap 235 is opened, and next in step S209, the orifice-disposed face of the recording head is wiped, and furthermore, in step S210, the idle ejection operation is performed before the recording operation in step S211.

As long as the recording operation continues, steps S201 to S211 are repeated until step S203 judges the cap is opened and furthermore step S212 is selected. In step S212, judged is whether the recording operation has been performed continuously for more than 12 seconds, and if step S212 concludes that it is so, the idle ejection operation is performed during the recording operation in step S213. This idle ejection operation in step S213 is for removing the viscous ink fluid in the orifices from which the ink fluid have not almost been ejected for a long time in contrast to the orifices from which the ink fluids have been almost always ejected. After the idle ejection operation in step S213, the 12-SEC timer is reset for restart in step S214. Next, in step S215, judged is whether the recording operation has been continuously performed for more than 60 seconds or not. If the recording operation has been continuously performed for more than 60 seconds, the wiping operation is performed in step S216. By this wiping operation, the additive ink droplets and dusts adhesive on the orifice-disposed face of the recording head due to the mist of the ink fluid or the like during the recording operation can be removed so as to prevent these unfavorable substances on the recording head from causing the ejection direction failures and so on.

If it is judged in step S201 that the recording data does not arrive at the recording apparatus, that is, the apparatus is ready to start the recording operation, step S218 is executed next without considering whether the power switch 822 is turned on or off. In step S218, whether the recording head has not been used for a long time is judged by the 72-Hr timer. If step S218 concludes that the recording head has been used for the last 72 hours, whether the capping operation is performed or not is checked in step S219. In step S220, whether 30 minutes has passed since the last idle ejection operation was performed or not is judged by the 30-Min TIMER. If 30 minutes has passed, the idle ejection operation into the cap is performed in step S221. This procedure is based on the present invention. That is, by means that the orifice of the recording head is covered, and that the position of the piston of the suction pump used as communicating to the atmospheric air is determined adequately, the ink fluid can be discharged in the state that the ink fluid extraction route defined in the suction pump is disclosed to the atmospheric air. By means of this structure, the closed space defined by the cap and the recording head can be maintained to be humid enough, and as this space is communicated to the atmospheric air, the pressure variation in this space can be avoided so that a designated position of the meniscus of the ink fluid inside the recording head is established adequately.

As a result, it will be appreciated that an ordinary ejection operation of the ink fluid can be established without preparing the restoration procedures before the recording operations by preventing the ink fluid from being solidified due to the evaporation of the solvent component of the ink fluid.

In addition, it will be appreciated that solidification of the ink fluid due to the evaporation of the solvent component of the ink fluid can be prevented by discharging the almost viscous ink fluid from inside the orifice and by keeping humid inside the cap with the ink fluid discharged inside the cap.

When the ink fluid is ejected in the cap, the excess amount of the ink fluid or the ink fluid staying after the last ejection operation within the cap can be moved toward the suction pump in order to maintain the pressure balance. By means of this mechanism, it will be appreciated that the inside of the cap can be maintained to be humid and that the ink fluid inside the ejection restoration system is prevented from being solidified as well as the ink fluid inside the recording head.

And next, in step S222, the 30-Min timer is reset for restart. If step 218 concludes that more than 72 hours have passed, it is concluded that the restoration operation cannot be established only by the idle ejection operation in the cap after so long a period without ejecting ink fluid by the recording head. In this case, steps S119 to S222 are skipped. This means that the suction restoration is more effective than the ejection charge restoration and that an ineffective ejection operation only wastes the ink fluid.

THIRD EMBODIMENT

In this embodiment, in addition to the structure of above described second embodiment, an atmospheric temperature sensor measuring the temperature of the atmospheric air or a head temperature sensor, and an atmospheric humidity sensor measuring the humidity of the atmospheric air are used. By means of this structure, the repetition times of the idle ejection operations into the cap and its operational conditions can be optimized. The repetition times of the idle ejection operations per second is determined by, for example, the table shown below.

adjacent to the orifice is only heated up in order to reduce the viscosity of the ink fluid, the idle ejection operation into the cap is performed. In case that the temperature is low and the humidity is high, the ink fluid adjacent to the orifice is only heated up and the number of the idle ejection operations into the cap is made reduced or the period of the pulse is taken to be longer. And furthermore, in case that the temperature is high and the humidity is low, the number of the idle ejection operations into the cap is made increased or the period of the pulse is taken to be shorter. So far, the optimal conditions for the idle ejection operations into the cap can be established in responsive to the environmental changed in the atmospheric air. It will be appreciated that the number of the idle ejection operations can be reduced and the amount of the wasted ink fluid can be reduced in case of relatively good environmental conditions.

It will be appreciated that the reliability of the restoration operations can be increased by using the predefined ejection patterns for the numbers of the idle ejection operations. For example, by means that every five cycles of the idle ejection operations into the cap, the number of ejection repetitions is increased to be 10 times as large as other repetitive ejection operations, it will be appreciated that the ink fluid near the orifice can be replaced almost completely and the unfavorable substance adhesive to the orifice-disposed face around the orifice can be completely removed.

The present invention achieves distinct effect when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating

TABLE 1

| | | HUMIDITY | | |
|---|---|---|---|---|
| | | LOWER HUMIDITY | NORMAL HUMIDITY | HIGHER HUMIDITY |
| TEMPERATURE | LOW TEMPERATURE | HEATING 7 DROPLETS/ 20 SECONDS | HEATING 5 DROPLETS/ 30 SECONDS | HEATING 3 DROPLETS/ 30 SECONDS |
| | NORMAL TEMPERATURE | 7 DROPLETS/ 20 SECONDS | STANDARD 5 DROPLETS/ 30 SECONDS | 3 DROPLETS/ 30 SECONDS |
| | HIGHER TEMPERATURE | 7 DROPLETS/ 20 SECONDS | 5 DROPLETS/ 20 SECONDS | 5 DROPLETS/ 20 SECONDS |

As the ink fluid get more viscous and dry when the temperature and the humidity of the atmospheric air are lower, the electro-thermal conversion element (ejection heater) is driven by pulses with shorter pulse width so that bubbles may not occur in the ink fluid, and after the ink fluid portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.– 70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, as an output device of a facsimile apparatus having a transmission and receiving function, and as an output device of an optical disc apparatus for recording and/or reproducing information into and/or from an optical disc. These apparatus requires means for outputting processed information in the form of hard copy.

Figure 18:
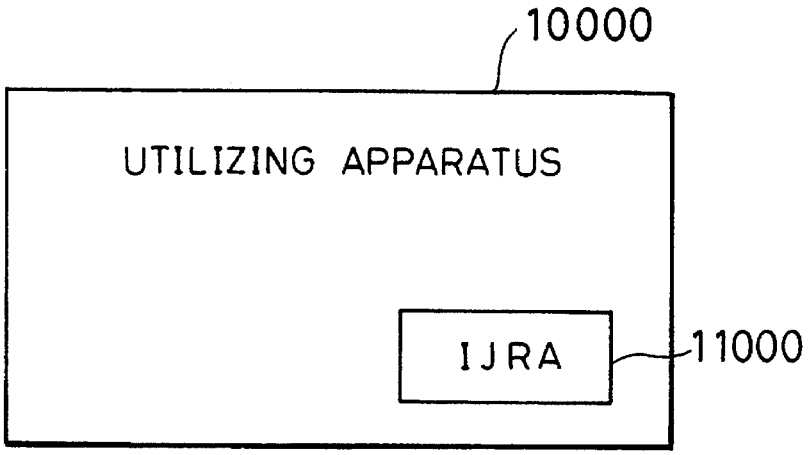
FIG. 18 is a schematic diagram illustrating an embodiment of an apparatus to which the ink jet recording apparatus in accordance with the present invention is equipped.

FIG. 18 schematically illustrates one embodiment of a utilizing apparatus to which the ink jet recording apparatus shown in FIGS. 2 and 13 can be equipped as an output means for outputting processed information.

In FIG. 18, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIGS. 2 and 13. The ink jet recording apparatus (IJRA) 11000 receives processed information form the utilizing apparatus 10000 and provides a print output as hand copy under the control of the utilizing apparatus 10000.

Figure 19:
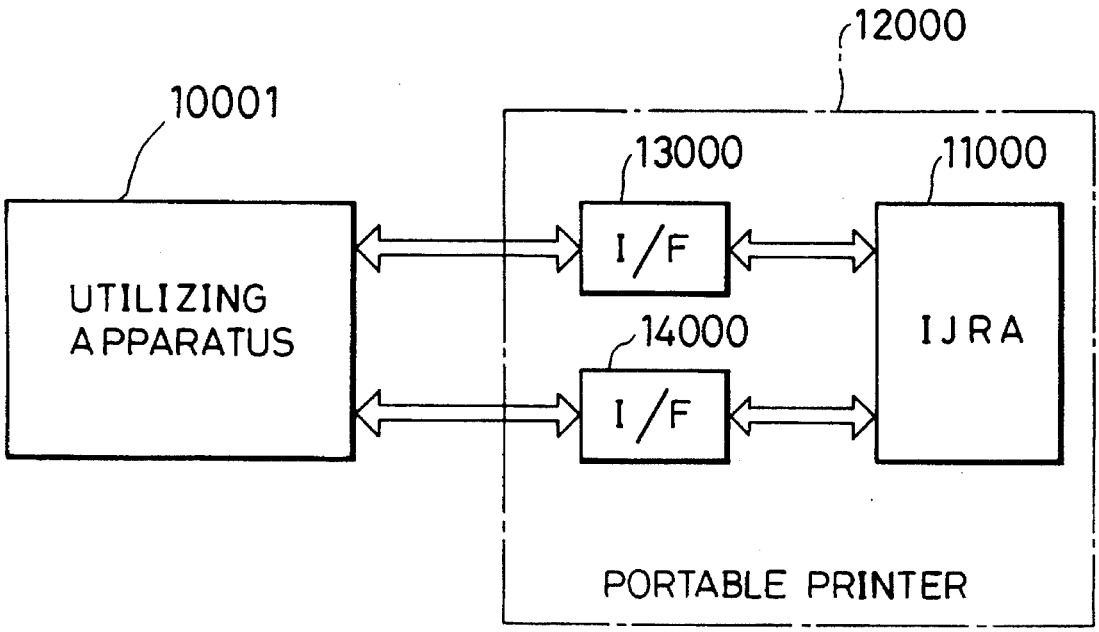
FIG. 19 is a schematic drawing illustrating an embodiment of a portable printer in accordance with the present invent ion.

FIG. 19 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 19, reference numeral 10001 schematically denotes such a utilizing apparatus. Reference numeral 12000 schematically denotes a portable printer having the ink jet recording apparatus (IJRA) 11000 shown in FIG. 7 is incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ejection restoration method for an ink jet apparatus including an ink jet head with a face having an ejection orifice for ejecting ink using thermal energy produced by a heating element and a cap member for covering said face, said method comprising the steps of:

covering said face with said cap member;

producing with said heating element thermal energy to a degree such that ink is not ejected, while said cap member covers said face;

ejecting ink from said ejection orifice into said cap member, while said cap member covers said face; and cleaning said face by removing ink therefrom when said cap member is separated from said face, wherein at least said producing step is performed before said cleaning step.

2. A method as claimed in claim 1, wherein a space formed between said cap member and said face communicates with atmosphere during said electing step.

3. A method as claimed in claim 2, wherein said producing step is performed when at least four hours have passed after a preceding ejection restoration.

4. A method as claimed in claim 2, wherein said producing step is performed before an ejection restoration operation.

5. A method as claimed in claim 1, wherein a step of producing with said heating element thermal energy such that ink is not ejected or a step of ejecting ink from said ejection orifice follows said cleaning step.

6. A method as claimed in claim 1, wherein a temperature achieved in said producing step is higher than a temperature achieved during an operation in which ink is ejected from said ejection orifice for recording.

* * * * *

UNITED STATES PATENT AND TRADEMARK OFFICE

CERTIFICATE OF CORRECTION

PATENT NO. : 5,493,319

DATED : February 20, 1996

INVENTOR(S) : Hiromitsu Hirabayashi, et. al.

It is certified that error appears in the above-indentified patent and that said Letters Patent is hereby corrected as shown below:

Title page, item [54] and col, 1, line 2, title, should read--METHOD OF RESTORING INK EJECTION BY HEATING AN INK JET HEAD BEFORE CLEANING--.

Signed and Sealed this

Eighteenth Day of March, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,493,319

DATED : February 20, 1996

INVENTOR(S) : HIROMITSU HIRABAYASHI ET AL.

It is certified that error appears in the above-identified patent and that said Letters Patent is hereby corrected as shown below:

On the title page, item

AT [56] REFERENCES CITED

Foreign Patent Documents,
"03073352 3/1991 Japan" should read
--3-73352 3/1991 Japan--.
insert, --3736916 5/1988 Germany
62-113561 5/1987 Japan
62-113560 5/1987 Japan--.

U.S. Patent Documents, insert
--5,153,614 10/1992 Yamaguchi et al.
4,970,527 11/1990 Gatten--.

COLUMN 1

Line 17, "also" should read --also been--.
Line 20, "will" should read --well--.
Line 29, "diminish" should read --diminution--.

COLUMN 2

Line 23, "adhere" should read --that adhere--.
Line 34, "being evaporated" should read --evaporating--.

COLUMN 3

Line 67, "ink" (2nd occurrence) should be deleted.

UNITED STATES PATENT AND TRADEMARK OFFICE

CERTIFICATE OF CORRECTION

PATENT NO. : 5,493,319

DATED : February 20, 1996

INVENTOR(S) : HIROMITSU HIRABAYASHI ET AL.

It is certified that error appears in the above-identified patent and that said Letters Patent is hereby corrected as shown below:

COLUMN 4

Line 34, "eject ion" should read --ejection--.
Line 37, "cannot" should read --cannot be--.
Line 55, "in side" should read --inside--.
Line 62, "arise" should read --give rise to--.

COLUMN 5

Line 1, "that is" should read --that is,--.
Line 4, "arising" should read --giving rise to--.
Line 11, "heat" should read --head--.
Line 43, "of them" should read --thereof--.

COLUMN 6

Line 43, "an" should be deleted.

COLUMN 8

Line 19, "invent ion." should read --invention.--.

COLUMN 9

Line 53, "a" should be deleted.
Line 62, "(No. 22878/1989" should read --(No. 122878/1989--.

COLUMN 11

Line 26, "include" should read --includes--.
Line 61, "826" should read --826.--.

UNITED STATES PATENT AND TRADEMARK OFFICE

CERTIFICATE OF CORRECTION

PATENT NO. : 5,493,319

DATED : February 20, 1996

INVENTOR(S) : HIROMITSU HIRABAYASHI ET AL.

It is certified that error appears in the above-identified patent and that said Letters Patent is hereby corrected as shown below:

COLUMN 13

Line 7, "and when" should read --and during--.

COLUMN 14

Line 25, "this" should read --these--.
Line 41, "detect" should read -detects--.
Line 63, "hours, is one of" should read --hours; this is one of the--.
Line 64, "responsive" should read --response--.

COLUMN 15

Line 17, "this" should read --these--.
Line 67, "be" should be deleted.

COLUMN 16

Line 1, "remained" should read --remain--.

COLUMN 17

Line 43, "inside" should read --the inside--.
Line 45, "moisten" should read --moist--.
Line 50, "step Si11," should read --step S111,--.

COLUMN 18

Line 31, "in" (2nd occurrence) should be deleted.
Line 33, "in" (2nd occurrence) should be deleted.

UNITED STATES PATENT AND TRADEMARK OFFICE

CERTIFICATE OF CORRECTION

PATENT NO. : 5,493,319

DATED : February 20, 1996

INVENTOR(S) : HIROMITSU HIRABAYASHI ET AL.

It is certified that error appears in the above-identified patent and that said Letters Patent is hereby corrected as shown below:

COLUMN 19

Line 26, "move" should read --more--.
Line 27, "that" should read --than--.
Line 41, "responsive" should read --response--.
Line 42, "passe" should read --passed--.

COLUMN 20

Line 25, "inside" should read --the inside--.
Line 61, "in" should be deleted.

COLUMN 21

Line 16, "in" should be deleted.
Line 19, "in" (1st occurrence) should be deleted.

COLUMN 22

Line 12, "in" should be deleted.
Line 16, "responsive" should read --response--.
Line 23, "responsive" should read --response--.
Line 30, "moves" should read --move--.
Line 31, "in" should be deleted.
Line 32, "responsive" should read --response--.

COLUMN 23

Line 19, "urethan" should read --urethane--.
Line 28, "responsive" should read --response--.
Line 38, "moves" should read --move--.

UNITED STATES PATENT AND TRADEMARK OFFICE

CERTIFICATE OF CORRECTION

PATENT NO. : 5,493,319

DATED : February 20, 1996

INVENTOR(S) : HIROMITSU HIRABAYASHI ET AL.

It is certified that error appears in the above-identified patent and that said Letters Patent is hereby corrected as shown below:

COLUMN 24

Line 42, "urethan" should read --urethane--.

COLUMN 25

Line 31, "responsive" should read --response--.
Line 32, "responsive" should read --response--.
Line 57, "nor" should read --not--.

COLUMN 26

Line 58, "TIMER." should read --timer.--.

COLUMN 27

Line 63, "get" should read --becomes--.

COLUMN 28

Line 9, "made" should be deleted.
Line 12, "responsive" should read --response-- and "changed" should read --changes--.

COLUMN 29

Line 29, "consists" should read --consist--.

COLUMN 30

Line 44, "form" should read --from--.

UNITED STATES PATENT AND TRADEMARK OFFICE

CERTIFICATE OF CORRECTION

PATENT NO. : 5,493,319

DATED : February 20, 1996

INVENTOR(S) : HIROMITSU HIRABAYASHI ET AL. Page 6 of 6

It is certified that error appears in the above-identified patent and that said Letters Patent is hereby corrected as shown below:

COLUMN 32

Line 3, "electing" should read --ejecting--.

Signed and Sealed this

Eleventh Day of November, 1997

Bruce Lehman

*Attest:*

BRUCE LEHMAN

*Attesting Officer*

*Commissioner of Patents and Trademarks*